US007857965B2

(12) United States Patent
Bunger et al.

(10) Patent No.: US 7,857,965 B2
(45) **Date of Patent: *Dec. 28, 2010**

(54) PROCESS FOR ENHANCING THE VALUE OF HYDROCARBONACEOUS NATURAL RESOURCES

(75) Inventors: James W. Bunger, Salt Lake City, UT (US); Donald E. Cogswell, Salt Lake City, UT (US)

(73) Assignee: James W. Bunger and Associates Inc., Salt Lake City, UT (US)

( * ) Notice: Subject to any disclaimer, the term of this patent is extended or adjusted under 35 U.S.C. 154(b) by 793 days.

This patent is subject to a terminal disclaimer.

(21) Appl. No.: 11/098,882

(22) Filed: Apr. 4, 2005

(65) Prior Publication Data

US 2005/0167337 A1 Aug. 4, 2005

Related U.S. Application Data

(63) Continuation of application No. 09/979,702, filed as application No. PCT/US00/14128 on May 23, 2000, now Pat. No. 6,875,341.

(60) Provisional application No. 60/135,611, filed on May 24, 1999.

(51) Int. Cl.
*C10G 21/00* (2006.01)

(52) U.S. Cl. ..... 208/254 R; 208/92; 208/95; 208/96; 208/208 R; 208/254 H; 208/282; 208/287

(58) Field of Classification Search ..... 208/87, 208/92, 95, 96, 208 R, 254 R, 254 H, 282, 208/287

See application file for complete search history.

(56) References Cited

U.S. PATENT DOCUMENTS

| | | | | |
|---|---|---|---|---|
| 2,662,843 | A * | 12/1953 | Castner et al. | 208/254 R |
| 3,317,623 | A * | 5/1967 | Sidney | 585/26 |
| 3,718,545 | A * | 2/1973 | Horlenko | 203/15 |
| 4,209,385 | A * | 6/1980 | Stover | 208/254 R |
| 4,623,444 | A * | 11/1986 | Che et al. | 208/92 |
| 6,875,341 | B1 * | 4/2005 | Bunger et al. | 208/254 R |

* cited by examiner

*Primary Examiner*—Prem C Singh
(74) *Attorney, Agent, or Firm*—James L. Sonntag

(57) ABSTRACT

A process for upgrading hydrocarbonaceous oil containing heteroatom-containing compounds where the hydrocarbonaceous oil is contacted with a solvent system that is a mixture of a major portion of a polar solvent having a dipole moment greater than about 1 debye and a minor portion of water to selectively separate the constituents of the carbonaceous oil into a heteroatom-depleted raffinate fraction and heteroatom-enriched extract fraction. The polar solvent and the water-in-solvent system are formulated at a ratio where the water is an antisolvent in an amount to inhibit solubility of heteroatom-containing compounds and the polar solvent in the raffinate, and to inhibit solubility of non-heteroatom-containing compounds in the extract. The ratio of the hydrocarbonaceous oil to the solvent system is such that a coefficient of separation is at least 50%. The coefficient of separation is the mole percent of heteroatom-containing compounds from the carbonaceous oil that are recovered in the extract fraction minus the mole percent of non-heteroatom-containing compounds from the carbonaceous oil that are recovered in the extract fraction. The solvent-free extract and the raffinate concentrates may be used directly or processed to make valuable petroleum, chemical or industrial products.

16 Claims, 7 Drawing Sheets

Preferred Process

Preferred Process

Dealkylation Process

Product Purification Scheme

Solvent Recovery System

Note: P = polar, NP = non-polar, S = sovlent; where parentheses ( ) are shown, the material within is present at a low concentration.

Energy Efficient Hydropyrolysis Process

Alternative Process

Second Alternative Process

PROCESS FOR ENHANCING THE VALUE OF HYDROCARBONACEOUS NATURAL RESOURCES

CROSS REFERENCE TO RELATED APPLICATIONS

This application is a continuation of U.S. patent application Ser. No. 09/979,702, filed 26 Nov. 2001 now U.S. Pat. No. 6,875,341, which is a national stage filing from PCT/US00/14128 filed 23 May 2000, which claims priority from U.S. Provisional Patent Application 60/135,611, filed 24 May 1999, all of which are incorporated by reference.

FIELD OF THE INVENTION

This invention relates to treatment of kerogen oil and other hydrocarbonaceous natural resources.

BACKGROUND OF THE INVENTION

Modern technologies for the manufacture of organic chemicals, fuels, lubricants, asphalts, solvents and other carbon-based products are based largely on using natural gas and petroleum as feedstocks. Attempts to substitute other hydrocarbonaceous natural resources such as shale oil, coal-derived liquids, or biomass into modern technology process sequences have proven to be economic failures, primarily because these hydrocarbonaceous resources are expensive to produce, compared to petroleum, and possess higher concentrations of heteroatoms (nitrogen, oxygen and sulfur) than petroleum, requiring additional processing such as catalytic hydroprocessing to remove these heteroatoms and render the processed material more like petroleum.

For example, kerogen oil is derived from kerogen, the solid hydrocarbon contained in oil shale rock. Oil shale is a hydrocarbon bearing rock that occurs in various places in the world (Kirk-Othmer Concise Encyclopedia of Chemical Technology, Wiley-Interscience, 1985 p 811). Kerogen oil is a liquid product recovered from oil shale through a pyrolysis reaction using thermal retorts. The liquid product so produced is also referred to as raw shale oil or simply shale oil. Kerogen oil may be high in nitrogen content when recovered from Green River Formation oil shale (U.S.A.), high in oxygen content when recovered from Kukersite oil shale (Estonia) or may contain other combinations of heteroatoms.

In prior commercial attempts, raw Green River Formation shale oil was sent to a catalytic hydroprocessing unit where nitrogen, sulfur and metals were reduced or removed. The processed shale oil that has had its nitrogen, sulfur and metals content reduced or removed by the catalytic hydroprocessing was then fed to a petroleum refinery where it was refined into petroleum products. Because the final products competed in the marketplace with products made from petroleum, the market value of shale oil products was fixed by petroleum economics. In the prior art the cost for recovering raw shale oil, processing the raw shale oil by catalytic hydroprocessing and refining the processed oil for fuels exceeded the value of the finished product, thereby making production of commodity petroleum products from oil shale uneconomical. A similar situation exists for liquids derived from coal liquids, oil shales in other parts of the world, and biomass. In each case the cost to produce the raw oil and to subsequently remove the heteroatoms so that it is acceptable as a substitute petroleum exceeds the value of the finished product.

If, instead of destroying the heteroatom-containing compounds by catalytic hydroprocessing, the heteroatom compounds were extracted and used for their unique chemical values the economics of non-conventional hydrocarbonaceous natural resource production may be dramatically improved.

DESCRIPTION OF PRIOR ART

Hundreds of U.S. patents have been issued covering retorting of oil shale to produce raw shale oil. A few examples are U.S. Pat. Nos. 3,736,247, 3,597,347 and 2,501,153. Numerous patents have been issued for catalytic hydrodenitrogenation (HDN) of raw shale oil to produce a refinery feedstock. For example, U.S. Pat. No. 4,462,897 to Miller describes a process for hydrotreating a whole shale oil with hydrogen in the presence of the invented catalyst. U.S. Pat. No. 4,022,682 to Bludis, et. al. Describes a process for hydrodenitrogenation of a shale oil to convert it to a feed oil for zeolitic riser cracking. Other examples can be found that have as their objective the hydrogenative removal of nitrogen from the molecules within which they are bound."

A few examples include patents that discuss extraction as a means of upgrading shale oil for refinery feed. In U.S. Pat. No. RE. 31,363 (U.S. Pat. No. 4,209,385) to Stover a method is disclosed for removing nitrogen compounds from shale oil using a mixture of organic acids and mineral acids. The method discloses conditions deemed to maximize the removal of nitrogen compounds which require a combination of acids and water, used in " . . . a significant excess of the selective solvent system . . . " compared to shale oil [p. 7, l. 48-49]. The Stover method suggests the use of the nitrogen-containing extract " . . . as an asphalt . . . " [p. 8, l. 68] and suggests the recovery of selective solvent by volatilization. However, the method cites no specific examples of the practicability of using the extract as an asphalt or recovery of the solvent by volatilization.

In fact, recovery of a mixed organic and mineral acid in the presence of up to 50% water as specified in the examples is impracticable by any common methods. Recovery by volatilization would require a deep distillation that would result in ineffective separation of solvent from low boiling components of shale oil. The preferred conditions as illustrated by the examples reveal the need for large quantities of solvent of at least three parts solvent to one part oil for each stage of extraction. If two stages are utilized to better remove the nitrogen from the shale oil as taught by the invention total ratios of 10:1 are required. Recovery of 10 parts of solvent for each part of oil is prohibitively expensive.

The use of extract as an asphalt is likewise not shown by a practical example. In fact, the extract from a raw shale oil would be by itself too low in viscosity to be an effective asphalt binder. Oil shale does not contain the high boiling constituents (>530° C.) that are present in petroleum from which conventional asphalts are made and which are the compounds primarily responsible for the semi-solid rheologic properties required for a specification asphalt.

Other patented processes likewise teach the use of acid for removal of nitrogen compounds, cf. U.S. Pat. No. 2,309,324 to McAllister, U.S. Pat. No. 2,541,458 to Berg, U.S. Pat. No. 2,035,102 to Stratford, U.S. Pat. No. 4,623,444 to Che and U.S. Pat. No. 2,848,375 to Gatsis. These disclosures are aimed at improving the quality of the oil for purposes of petroleum refining, as an alternative to HDN. However, in none of the above-referenced patents are processes disclosed which are practiced under conditions which are commercially viable nor do these patents offer any practicable means for recovery, control and reuse of extraction solvent, nor do they offer uses of extracted material that commands appreciable value in the marketplace.

Even though it would be obvious that the extracted nitrogen compounds would need to be disposed of or used, the patents do not disclose an intended use nor do they suggest that the intent of the extraction is to recover valuable nitrogen-containing products. In fact, the use of mineral acids virtually precludes that nitrogen compounds could be practically recovered in valuable form, because the mineral acid must first be neutralized and the nitrogen compounds must then be back-extracted from the aqueous solution. The process of recovery would effectively destroy the extraction solvent. The resulting 'salt' solution would not be suitable for recycle and would require disposal. The net result is a costly, environmentally unacceptable and uneconomical process. Further, the extraction conditions disclosed in the examples require large amounts of solvent and no suggestion is made for a process by which the nitrogen compounds could be practically recovered from the large amounts of solvent.

Che discloses the desirability of high selectivity, but fails to define what is meant by selectivity. The specification cites the desirability of first distilling the shale oil into a lighter fraction and heavier fraction and separately processing these fractions. Selectivity is achieved by "Dividing the shale oil into fractions according to boiling point, which generally divides the shale oil into fractions according to molecular weight. This reduces the competing solubilization of lighter non-nitrogen-containing compounds with the result and effect that heavier nitrogen-containing compounds compete only with heavier non-nitrogen-containing compounds. The selectivity and efficiency of such a chemical extraction involving only lighter shale oil compounds, separated from heavier shale oil compounds by a distillation, is enhanced because the solubility of lighter nitrogen-containing compounds in the immiscible solvent is significantly greater than that of lighter non-nitrogen-containing compounds and there are no heavier nitrogen-containing compounds required to be extracted."

The practical result of this approach, that is, first dividing the shale oil into a multiplicity of fractions and subsequently processing of each fraction to produce separate extracts and raffinates, is to produce so many separate process streams that separately processing each stream to produce marketable products adds capital and operating costs that cannot be recovered by the value of the end products. Additionally, Che does not disclose a practical means of solvent recovery nor uses for extracted nitrogen components.

In summary, in the prior-art, the nitrogen (heteroatom-containing) compounds in shale oil are materials that are to be removed, i.e., substances regarded as objectionable and of little worth, and that are to be destroyed or discarded. If any value is derived from the nitrogen materials, it is only incidental to the main object of increasing the value of the shale oil for purposes of refining by removing the nitrogen compounds. Consequently, the nitrogen-containing extracts have generally been viewed as low- or no-value products.

The applicants have found, however, that the nitrogen compounds in shale oil in themselves are valuable and the derivation of high-value nitrogen and other hetero-atom compounds from shale oil can be a primary and integral object in deriving value from shale oil. Until applicants discovery that the value of shale oil was not only for manufacture of petroleum fuel products, but also as a feed-stock for manufacture of high-value chemical compounds, the object in the industry was to maximize the fuel value of the oil shale. There has previously been motivation in the industry to optimize the value of the nitrogen compounds, in addition to the fuel values of shale oil. This is because it was assumed that the nitrogen compounds were essentially waste and could not be viably made into a high-value product.

OBJECTS OF THE INVENTION

It is, therefore, an object of the invention to provide a process that will extract and convert compounds contained in oil from hydrocarbonaceous natural resources to produce products that are more valuable to the marketplace than products made from a traditional petroleum refinery.

It is further an object of the invention to provide a method for selecting a solvent system that is used in low solvent-to-oil ratios and which is easily recoverable for reuse.

It is further an object of this invention to provide a process for maximizing the extraction of heteroatom-containing compounds while at the same time minimizing the extraction of non-heteroatom-containing hydrocarbon compounds.

It is further an object of the invention to provide a process for concentrating valuable chemical materials from kerogen oil.

It is further an objective of the invention to provide a process for upgrading the concentrate high in heteroatom-containing compounds to valuable products.

It is further an objective of the invention to provide a process for upgrading non-heteroatom-containing compounds to petroleum refining feedstock.

It is a further object of this invention to produce products that are of sufficient value and at a sufficiently low cost that production of kerogen oil is economical.

Further objects of the invention will become evident in the description below.

SUMMARY OF THE INVENTION

An embodiment of the invention is a process wherein hydrocarbonaceous oil, which is a mixture of organic compounds comprising primarily C, H, N, S and O, is treated in a liquid-liquid extraction process with a selected polar solvent to extract heteroatom-containing compounds from non-heteroatom-containing compounds with a high coefficient-of-separation (COS). The heteroatom-containing compounds recovered from the polar solvent are then used directly as a valuable specialty or commodity products or they are fed to an upgrading processes where they may be fractionated, derivatized or subjected to a dealkylation environment and otherwise processed to manufacture specialty or commodity products. The dealkylation process reduces the molecular weight of the heteroatom-containing molecule by cracking off non-heteroatom-containing side chains and saturated ring systems from the aromatic and resonance-stabilized ring systems. The product is a concentrate of valuable heteroatom-containing materials, which are materials originally in the hydrocarbonaceous oil and derived from higher molecular weight heteroatom materials that have been freed or dealkylated of non-heteroatom-containing side chains and saturated ring systems. The dealkylated heteroatom-containing molecules, which are comprised largely aromatic or unsaturated ring systems and which contain heteroatoms within or directly bonded to the ring system, are then recovered, concentrated and further processed to produce marketable products. The non-heteroatom-containing compounds obtained from the extraction along with non-heteroatom-containing alkyl groups produced in a dealkylation process and recovered with the raffinate in the extraction process are processed for petroleum products, such processing being greatly simplified by the prior removal of a large portion of the heteroatom-containing compounds.

In a preferred embodiment shown in FIG. 1, Green River Formation kerogen oil is first extracted by a polar solvent applied in proportions of approximately 0.5-2.0:1.0 to generate a polar extract and a non-polar raffinate. Solvent is recovered by distillation for reuse by the practice of the invention. The polar extract may be used directly as a commodity such as an antistripping agent in asphalt blends, as a dispersant for marginally compatible process streams or for other applications for broad-range concentrates, or it may be processes for more refined, specification products. In a preferred embodiment the polar extract is distilled to separate the extract into light, middle and heavy molecular weight fractions. The middle distillate stream may be sent to a cracking unit where alkyl groups are removed from heteroatom-containing ring systems. The product from the cracking unit may be returned to the extraction unit where the dealkylated heteroatom-containing rings are separated from the non-heteroatom-containing alkyl groups. By distillation after the extraction unit, the dealkylated heteroatom-containing rings are recovered in the light distillate stream along with the lower molecular weight heteroatom-containing molecules originally in the kerogen oil. The light distillate may be sent to a more severe thermal hydrodealkylation unit (FIG. 2) to remove remaining methyl groups where the products may be purified (FIG. 3) to pure compounds. A drag stream may be drawn from the hot receiver in the cracking unit to prevent buildup of heavy non-reacting substances in the system. The heavy distillate from the distillation of the polar extract and material recovered in the drag stream from the cracking unit may be used directly as an antistripping agent in asphalt blends or as a dispersant for marginally compatible process streams or an asphalt additive or for other uses as specified below. The non-polar raffinate may be sent directly to a petroleum refinery or sent to a catalytic hydrotreating unit for reduction of nitrogen and sulfur, making this material directly amenable to petroleum refining or for other uses as specified below.

An advantage of the present invention is that the raffinate and extract process streams can each be processed economically into products, with little or no "waste" streams that have little or no value in market. This is because the molecular compounds that contain the heteroatoms are concentrated in the extract, substantially free of non-heteroatom-containing compounds, and conversely, the non-heteroatom-containing compounds are concentrated in the raffinate, substantially free of heteroatom-containing compounds.

Further, it is possible to adjust the process of the invention to respond to market demands of products that may have limited demand. For example, when end-use consumption limits the amount of very high value products that can be marketed, the process of the invention can be operated to produce more of the broad-range concentrate that is not as limited by end-use consumption, without having to reduce total process throughput, which would result in adverse economic consequences. Such a flexibility is not possible with prior-art system, where low value, or unmarketable waste streams must be processed and disposed of. Furthermore, in prior-art systems, any so-called by-product streams are usually produced at costs above the market value, which requires that the more valuable product streams subsidize the lower value streams in order to make the process profitable. Because the revenue from the high-value streams is required to pay for losses of the by-products, the process must produce a maximum amount of high-value product, or it is not viable. In addition, the margin for the high-value product is lower, because revenue is required to offset the cost of the by-product production.

In the present process, adjustment to the process can be made so that each of the products is basically "self-sufficient". This allows a greater flexibility, because production of high value streams is not required to subsidize the lesser value by-product streams. Pricing of the high-value products is more flexible, and can be sold at cost, if market conditions require, because its revenue is not required to subsidize the rest of the process.

In the present invention, hydrocarbonaceous oils are separated into a raffinate and extract fraction. The raffinate is depleted of heteroatoms, and therefore can be easily and economically used as a feed for a petroleum refinery with little or no processing. The extract is enriched in heteroatom compounds, but can be used directly as a valuable product or further processed to produce marketable heteroatom chemical compounds.

This contrasts with the typical approach in the prior-art, wherein oils are upgraded by removing heteroatom compounds, but with the production of heteroatom waste-streams that are difficult to dispose of, or cannot be made marketable without expensive processing. In addition, the composition of the heteroatom-containing extract stream in the present invention is such that expensive processing is not required to form an economically viable product from the extract. The solvent system in the extraction is not used in an excessive volume, and is in a chemical form that is relatively inexpensive to remove from the extract and recycled. The extract can then be further processed for production of high-value products, such as pyridine or resorcinol, or used essentially as-is for products of intermediate value, but which in the market can be produced at a higher volume, such as an asphalt or crude oil additive. In response to a good market, the process of the invention can be adjusted to maximize the production of a processed high-value product, or to a direct, intermediate value, but higher volume product; in the event the market for the high-value material becomes saturated. The ability to produce a processed, high-value product and a direct, unprocessed product simultaneously also allows the practitioner to build a plant that is much larger than would be justified if only the high-value product was being produced. This permits exploitation of the economies of scale, without which a process for the high-value product would be uneconomical.

A discovery related to the present invention is that a large portion of the heteroatom molecules in hydrocarbonaceous resources are chemically related to valuable heteroatom feedstocks, such as pyridine and picoline. For example, pyridine-type chemical structures have not been evident in abundance by typical prior-art chemical analysis of Green River Formation kerogen oil, but it has been found by the applicants that such chemical structures do exist in significant amounts, but combined with side chains. By removing the side chains, which are mostly alkyl in nature, certain valuable heteroatom compounds can be produced. In the prior-art it had been assumed that heteroatom molecules in carbonaceous oils were of a complex nature that could not easily, if at all, be converted to valuable heteroatom products. According, by the approach in the prior-art the heteroatom portion of carbonaceous oils was regarded as something to be destroyed or removed and discarded as something of little worth. In the present invention, the discovery of the chemical nature of the carbonaceous oil has lead to an economical process wherein both the non-heteroatom and heteroatom constituents are economically exploited. The recognition of the chemical structure of the heteroatoms has also led to the recognition that these compounds have value directly as-is, without processing to remove the side-chains. Accordingly, the heteroatom mixture of the extract has been found valuable for such uses as asphalt additives, and other uses which are further enumerated herein. The discovery that the heteroatom extract can be used as-is for products with a relatively high market volume, or can be processed to compounds with a high-value but with a limited market volume, has led to the invention of the present process wherein it is possible to adapt the process toward either a direct extract product or a processed extract, depending upon market conditions. For example, if the market for the high-value, low-volume process product becomes saturated or the price becomes depressed, production can be directed to the intermediate value high-market volume material. This ensures that the capacity of the plant will always be utilized, and that a profitable product can be made, regardless of market conditions.

DETAILED DESCRIPTION OF THE INVENTION

Figure 1:
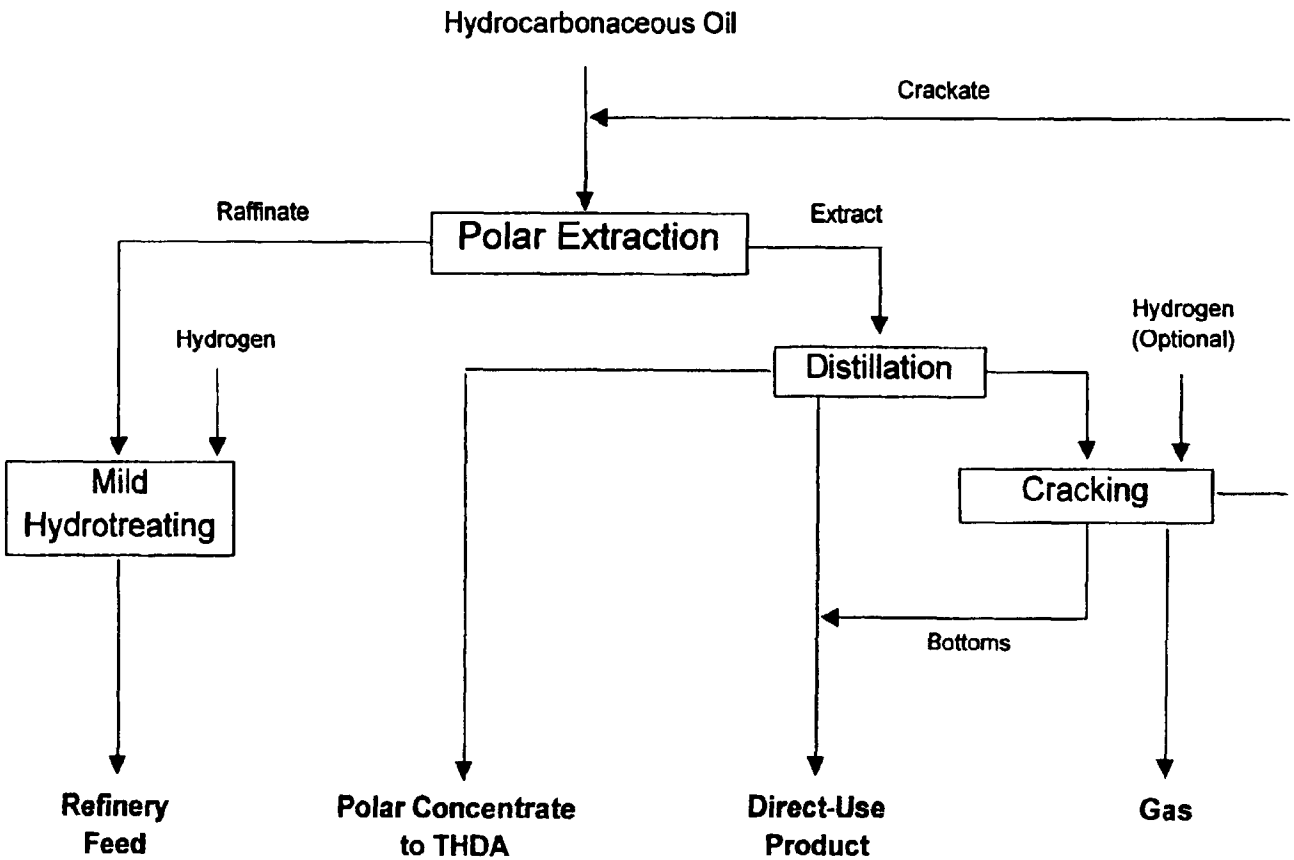
FIG. 1 is a block diagram of a preferred process of the invention.

Oils for treatment by the invention are those derived by extraction or heat treatment of carbonaceous materials, e.g., oil shale, oil sands, tar sands, coal, gilsonite or biomass.

Definition of Oils

"Oil shale consists of a marlstone-type sedimentary inorganic material that contains complex organic polymers that are high molecular weight solids. The organic kerogen is a three-dimensional polymer, insoluble in conventional organic solvents, and associated with small amounts of a benzene-soluble organic material, bitumen. . . . Oil shale deposits occur widely throughout the world [and] the geology and the composition of inorganic and organic components of oils shale varies with deposit location." Kirk-Othmer, Concise Encyclopedia of Technology, 1985 (John Wiley & Sons).

Oil sands, also known as tar sands or bituminous sands, are sand deposits impregnated with dense, viscous petroleum. In the United States "Tar sand is any consolidated or unconsolidated rock (other than coal, oil shale or gilsonite) that either: (1) contains a hydrocarbonaceous material with a gas-free viscosity, at original reservoir temperature, greater than 10,000 centipoise; or (2) contains a hydrocarbonaceous material and is produced by mining or quarrying." PL-97-78, Combined Hydrocarbon Lease Act (CHLA)—1981.

"Coal is a dark burnable solid, usually layered, that resulted from the accumulation and burial of partially decayed plant matter over earlier geologic ages." Kirk Othmer Concise Encyclopedia of Chemical Technology, 1985 (John Wiley and Sons). Further, "the formation of coal, the variation in its composition, its microstructure and its chemical reactions indicate that coal is a mixture of compounds."

"Gilsonite is a natural hydrocarbon substance classed as one of the asphaltites. Asphaltites are asphalt-like substances characterized by their high softening point (above 110° C.)." Kirk-Othmer, op. Cit. p 559.

"Biomass is a renewable biological material, as agricultural or forestry waste or energy crops, used for the production of energy." Grant and Hackh's Chemical Dictionary, $5^{th}$ Ed., McGraw Hill (1987).

With each of the above-described natural resources, the oil derived from them is comprised of a mixture of compounds, some of which contain no heteroatoms and are desirable for refining to petroleum products, and others of which contain heteroatoms and are undesirable for refining to petroleum products. In each case it is the objective of the invention to selectively recover those components which are undesirable for refining to petroleum products, to concentrate these components and to produce chemical or commodity products, other than direct petroleum products such as fuels and lubricants, that command value in the marketplace.

Any hydrocarbonaceous product having sufficient amounts of heteroatom-containing molecules to justify their recovery as a valuable product are contemplated as an oil source for the process of the invention.

Oil Pretreatment

Depending upon the method of producing the oil it may be desirable but not necessarily a requirement to pretreat the oil for removal of solids, insolubles, salts or other heterogeneous (mixed phase) substances. Such removal may be made by any convenient means such as filtration, centrifugation, settling, washing, decanting and the like.

If desired for purposes of enhancing the recoverability of extraction solvent or for other downstream process reasons the oil may be prefractionated by distillation. Such fractionation may consist solely of removing lower boiling components or it may include fractionation of one or more distillate fractions for independent processing. It is intended that any such pretreatment steps may be effected without departing from the spirit of the invention.

Liquid-Liquid Extraction

Any suitable liquid-liquid extraction apparatus may be used, preferably operated in a counter-current continuous mode. The solvent system comprises a major portion of a polar solvent and a minor portion of water. The polar solvent is selected and introduced in such a manner and in proportions that a separate phase is formed with the oil. Suitable polar extraction solvents include those that form a separate phase from the non-polar constituents of the oil, including, but not limited to, formaldehyde, formic acid, methanol, acetaldehyde, acetic acid, ethanol, propanol, isopropyl alcohol, furfural, phenol, sulfolane, N-methyl-2-pyrrolidone, or combinations of the above. Other solvents may include aldehydes, ketones, ethers, esters, amides, and amines which are generally comprised of 10 carbons or less.

A minor portion of water is present in the solvent system to act as an antisolvent. As more fully described below the antisolvent action of water decreases the solubility of heteroatom-containing compounds in the raffinate. In addition, solubility of the polar solvent system in the raffinate is decreased, which increases partitioning of heteroatom-containing compounds into the extract. The non-heteroatom-containing compounds are also directed to the raffinate by the presence of water, because water inhibits the solubility of non-heteroatom-containing compounds in the extract. In summary, water in the solvent system tends to reject solvent and heteroatom-containing compounds from the raffinate, and reject non-heteroatom-containing compounds from the extract.

Additionally, a light non-polar solvent may optionally be introduced in such a manner and in such a proportion to enhance the separation of phases when contacting the selected polar solvent with the oil. Suitable non-polar solvents include, but are not limited to, the lower normal paraffins such as n-propane, n-butane, n-pentane, n-hexane or n-heptane, and isoparaffins and cycloparaffins that are comprised generally of no greater than 7 carbons. It is contemplated that a non-polar solvent, if desired, would be used simultaneously with a selected polar solvent to achieve the objects of the invention.

The countercurrent extraction step may be preceded by one or more single-stage extraction steps or by presaturating the oil with either a polar solvent or a non-polar solvent, or both, as required to achieve the objects of the invention, so long as the total amount of solvent contacted does not exceed the maximum desirable amount as specified in its relationship to the amount of oil. The temperature (and pressure, if needed to achieve a desired temperature) of the extraction system may be varied to enhance the desired results.

In the practice of the invention the selection of the solvent system, the method of contacting, the solvent/oil ratio, the throughput rate, the contact temperature and other process variables are selected so as to achieve the following objectives.

To maximize the coefficient-of-separation (COS) between heteroatom-containing and non-heteroatom-containing compounds contained in the oil.

To minimize the solvent-to-oil ratio required to achieve a high COS.

To maximize the recoverability of the solvent system.

Maximizing COS

A coefficient of separation is defined as:

COS=mole % of desired compounds recovered in the fraction−mole % of undesired compounds recovered in the same fraction 1)

Thus, the COS may be applied in any convenient fashion to describe the degree to which the separation objectives have been achieved. To illustrate, if a kerogen oil consisting of 40% nitrogen-containing compounds and 60% non-nitrogen-containing compounds is extracted for the purpose of concentrating nitrogen-containing compounds, a perfect separation would be one in which all of the nitrogen-containing compounds would be recovered in the extract and none of the non-nitrogen-containing compounds would be recovered in the extract. Under these circumstances the calculated COS would be:

100=100% of nitrogen-containing compounds recovered−0% of non-nitrogen-containing compounds recovered 2)

To illustrate the opposite extreme consider a separation in which the same kerogen oil (containing 40% nitrogen-containing compounds) is simply divided between two containers in arbitrary proportions, say 30% in container A and 70% in container B. Under these circumstances a calculation of the COS for container A would be:

0=30% of nitrogen compounds recovered−30% of non-nitrogen compounds recovered

This is intuitively the obvious answer. A simple exercise will reveal by the definition provided that it makes no difference if the COS is calculated in reference to the extract or the raffinate in example-1 or in reference to container A or container B in example-2. The result will be the same.

The COS is calculated by measuring by any convenient means the concentration of both the desirable components and the undesirable components in the feedstock and in either the extract or the raffinate and applying the mathematical treatment described above. The maximum COS is achieved by varying the selection of solvent, the concentration of water, the temperature, the solvent-to-oil ratio, the number of extraction stages, the throughput rate and other process variables. In the practice of the invention it is the object of the invention to maximize the COS, consistent with the other objectives of the invention.

The COS is measured for the heteroatom compounds appropriate for the hydrocarbonaceous oil being extracted. For a kerogen oil derived from Green River Formation oil shale, the heteroatom content is principally nitrogen, and measurement of the COS for nitrogen-containing compounds will effectively measure the separation of heteroatom compounds. For a kerogen oil from Kukersite oil shale, the heteroatom content is principally oxygen, so measurement of the COS for oxygen-containing compounds would effectively measure the separation of heteroatom compounds. In general, separation of the heteroatom compounds can be measured by a COS of oxygen-containing compounds, or nitrogen-containing compounds, or a combination thereof, depending upon the heteroatom content of the hydrocarbonaceous oil. It is understood, that where, for example, a COS for extraction of nitrogen-containing or oxygen-containing oils is mentioned, the same teachings apply to other hydrocarbonaceous oils with different heteroatom contents. Further, the invention applies to heteroatom compounds other than those of nitrogen and oxygen, where the oil is of appropriate composition. The COS may also be applied to specific compound-types, e.g. pyridines, if these types are the desired components.

To illustrate, a kerogen oil derived from Green River Formation (U.S.A.) oil shale possessing 1.8% nitrogen and exhibiting an average molecular weight of 325 Dalton is added to a separatory funnel containing an equal weight of a selected solvent system comprised of 80% formic acid and 20% water. The temperature of the system is elevated to 40° C. to ensure no crystallization of waxes that are contained in the kerogen oil. The mixture is vigorously shaken until partitioning between the liquid phases is at equilibrium. The extract layer is first drawn from the bottom of the separatory funnel and kept separately from the top layer, or raffinate, which is successively drawn from the separatory funnel. After separate removal of solvent from the extract and from raffinate each are weighed and the nitrogen content of each is determined. The extract, comprising 37% of the feed, exhibits a nitrogen content of 4.0%. The raffinate, comprising 63% of the feed, exhibits a nitrogen content of 0.51%. The coefficient-of-separation for this extraction, assuming one nitrogen atom per nitrogen-containing molecule, is 77.7% and is calculated as follows:

the % total $N$ compounds in extract=4.0/1.8×(0.37)×100=82.2 and the % of total non-nitrogen compounds in the extract=[(100−4.0/14*325)0.37/(100−1.8/14*325)]×100=4.5 where 14 is the atomic weight of nitrogen. The COS for this extraction is therefore 82.2−4.5=77.7. The assumption of one heteroatom per heteroatom molecule is an approximation and the actual average number will usually be a larger number which can be determined by any convenient analytical method and considered in the calculation of the COS.

Selection of a Polar Solvent

The selection of polar solvent is made based on selectivity, ease of recovery, low reactivity and low cost. Selectivity is defined in terms of COS. Ease of recovery considers both recovery efficiency, defined as the percentage of solvent recovered per pass, and other handling characteristics such as low toxicity or corrosivity. Low reactivity is defined as exhibiting negligible chemical effects on the composition of the extract. Low cost implies that the solvent should not be difficult to synthesize.

In general, small molecules possessing dipole moments of greater than 1.0 Debyes are candidates for the selected polar solvent. Chlorinated or halogenated solvents are to be avoided, both because of the additional environmental hazards and the adverse effects the presence of halogens have on downstream processing. Other undesirable solvents are oxidizing solvents, reducing solvents, mineral acids and solvents that promote free radical or ionic polymerization reactions.

Examples of compounds that may be considered for polar extraction solvents and their gas phase dipole moments (in Debyes) are shown in Table 1:

TABLE I

| Solvent | Dipole Moments (Debyes) |
|---|---|
| Formaldehyde | 2.33 |
| Formic Acid | 1.41 |
| Methanol | 1.70 |
| Acetaldehyde | 2.69 |
| Acetic Acid | 1.74 |
| Ethanol | 1.69 |
| Propyl Alcohol | 1.68 |
| Isopropyl Alcohol | 1.66 |
| Furfural | >1.00 est. |
| Phenol | 1.45 |
| Sulfolane | >1.00 est. |
| N-methyl-2-pyrrolidone | >1.00 est. |

For example, when various selected solvents are employed to extract desired compounds from kerogen oil fractions typical results are shown in Table II.

TABLE II

Feedstock - Green River Formation Kerogen Oil
N Content - 1.6%
Avg. M.W. - 325 Daltons
Method - Single Stage Extraction

| Solvent System | % Extract | % Raffinate | % NEX | % NR | COS |
|---|---|---|---|---|---|
| 98% methanol/2% water | 10.0 | 90.0 | 3.2 | 1.4 | 16 |
| 100% acetic acid‡ | 16.6 | 83.4 | 2.9 | 1.3 | 22 |
| 80% formic acid/20% water | 17.4 | 82.6 | 3.5 | 1.2 | 32 |
| 23% formic acid/77% acetic acid | 36.3 | 63.7 | 3.3 | 0.6 | 61 |
| 100% formic acid‡ | 31.8 | 68.2 | 3.9 | 0.5 | 73 |
| 85% formic acid/15% water | 28.7 | 71.3 | 4.1 | 0.5 | 75 |
| 95% formic acid/5% water | 32.3 | 67.7 | 4.0 | 0.4 | 79 |
| 90% formic acid/10% water | 40.8 | 59.2 | 3.6 | 0.2 | 82 |
| 90% formic acid/10% water* | 30.0 | 70.0 | 4.3 | 0.4 | 80 |

*Multiple stage countercurrent extraction.

‡Although 100% acid is shown, because of the hydrophilic nature of these compounds, there would be under most practical conditions, water inherently present in the solvent system, and such a solvent system would be contemplated as a water-containing solvent system in the present invention.

The selected solvent system has a strong effect on the COS. The choice of the selected solvent system depends also on the nature of the feedstock.

In another example, equal portions of a selected solvent and a 200-275° C. distillate of a Green River Formation kerogen oil were extracted in a single-stage extractor. In the first case the selected solvent was pure methanol, in the second case the selected solvent was pure methanol to which 2.0 weight percent water was added. The results are shown in Table III.

TABLE III

Effect of Added Water on Extraction Results
Feedstock 200-275° distillate, Green River
Formation Kerogen Oil N content - 1.2%
Average MW - 220 Dalton

| | Methanol Only | Methanol + 2% Water |
|---|---|---|
| Extract | 44.7 | 33.3 |
| Raffinate | 55.3 | 66.7 |
| % N Recovered in Extract | 82.3 | 88.0 |
| % Non-N Recovered in Extract | 41.6 | 29.6 |
| COS | 40.7 | 58.5 |

The results show that adding a very small amount of water dramatically improves the COS. This results because of the antisolvent effects of water that acts to reject non-polar oils from the extract. The improvement in recovered nitrogen is due also to the antisolvent effect of water in reducing the solubility of the polar solvent, methanol, in the raffinate phase. The solubility of the nitrogen compounds in the raffinate is directly related to the amount of water and polar compounds remaining in the raffinate. Addition of water to the solvent system makes the solvent system less compatible with the raffinate and reduces the amount of solvent constituents in the raffinate phase. Reducing the amount of the solvent system constituents, the water and polar solvent, results in a less favorable partitioning of the nitrogen types into the raffinate phase. In general, the addition of water to any of the selected organic solvent systems is favorable, the percentage of water to be added being determined so as to maximize the COS. The limit to how much water can be added is determined by the solubility of the extract oil in the selected solvent system.

Selection of Non-Polar Solvent

Selection of a non-polar co-solvent is made based on selectivity, ease of recovery, low reactivity and low cost, as defined above. In general, the non-polar co-solvent serves to enhance the antisolvent effect of water.

In general, small molecules possessing a dipole moment of less than 0.1 Debyes are candidates for selection as non-polar solvents. Aromatic hydrocarbons are to be avoided because of their adverse effects on selectivity and olefins are to be avoided because of their instability and reactivity. Chlorinated or halogenated solvents are to be avoided because of their adverse effects on selectivity and undesirable environmental effects.

Suitable non-polar solvents include, but are not limited to normal paraffins, isoparaffins, and cycloparaffins with less than 7 carbon atoms. Examples, all of which exhibit dipole moments (in debyes) less than 0.1, are:

n-propane
n-butane
n-pentane
n-hexane
n-heptane
cyclopentane
methylcyclopentane
cyclohexane
methylcyclohexane The use of water as an anti-solvent in conjunction with a polar organic solvent and not as a principal extraction solvent is an important aspect of the invention. The addition of a non-polar solvent is optional to enhance the anti-solvent effects of water.

As an example of the addition of a non-polar solvent, a 200-550° C. distillate of Kukersite kerogen oil was vigorously shaken with 1.5 parts of polar solvent, comprised of 90% formic acid and 10% water, and 1.0 parts non-polar solvent, comprised of n-hexane (all parts by weight) and allowed to settle until 2 phases were formed. The bottom extract phase was separated from the top raffinate phase and the solvent was separately removed from each phase by distillation according to the practice of the invention. The extract amounted to 19% of the total distillate and raffinate amounted to 81% of the total distillate. The extract and raffinate were separately analyzed by a gas chromatograph equipped with a mass selective detector (GC-MSD) in a total ion current (TIC) mode.

Three compound-types of approximately the same molecular weight were selected to evaluate the separation; methylnaphthalenes, MN (142 amu), naphthols, NOH (144 amu), and dimethylresorcinols, DMR (138 amu). Each of these specific ions were integrated in the chromatograms for both the extract and the raffinate. Using customary methods for comparing relative concentrations and accounting for the yields of extract and raffinate in the extraction step it was determined that the recovery in the extract of MN was 4%, NOH was 51% and DMR was 88%. From this information three coefficients of separation can be determined as follows:

For the separation between DMR and MN; 84=88−4

For the separation between NOH and MN; 47=51−4

For the separation between DMR and NOH; 37=88−51

For this example the separation between DMR and MN is high. However, the separation of NOH from MN or DMR from NOH is less than optimum and may be improved through the teachings of this invention, namely by varying the selection of polar solvent, water-to-polar solvent ratio, selection of non-polar solvent, solvent-to-oil ratio, temperature, number of contact stages and the like and measuring the effect of variations on the COS.

It will be noted by the example that it is not possible to maximize both the separation of the NOH from the MN and the DMR from the NOH while at the same time maintaining a nearly ideal separation between the DMR and the MN. This example reveals that the choice of which species to consider the desirable species and which species to consider the less-desirable species must be made by the practitioner and that optimization of all of the practitioner's objectives may require successive and multiple applications of the practice of the invention.

It may be appreciated by one skilled in the art that the definition of the COS is broad and can be applied to any two compositional characteristics for which analytical information is available, and that such application is not restricted to the general class of heteroatom-containing compounds but may be applied to specific heteroatom-containing compounds or specific non-heteroatom-containing compounds to achieve the objectives of the invention.

Minimize Solvent-to-Oil-Ratio

It is desirable to minimize the solvent-to-oil ratio in order to reduce requirements for solvent recovery. For all selected solvent systems there will be a minimum amount of solvent that must be added to the oil in order to create two phases. This amount of solvent is the least amount that can be used in practice and will depend on the nature and composition of the oil, the structure of the solvent, the presence of other solvents, the temperature and the configuration of the extraction system. In practice, it may be desirable to use more than the minimum amount of solvent required to induce two phases, if by increasing the solvent-to-oil ratio the COS is increased correspondingly. In all practical systems it is expected that there will be a limit to the maximum amount of solvent that can be introduced to a fixed amount of oil before the COS will no longer rise and will begin to fall. The desired amount of solvent will be between the limits of the minimum amount required to create two phases and the amount required to maximize the COS. In the practice of the invention the selection of solvent and the temperature of extraction are chosen to maximize the COS while minimizing the solvent-to-oil ratio. For example Table IV shows the effect of solvent-to-oil ratio on extraction of a kerogen oil distillate.

TABLE IV

Feedstock - 200-275° C. distillate from Green River Formation kerogen oil N Content 1.2 wt. %
Average M.W. Nitrogen Compounds - 220 Dalton
Solvent System - 98% methanol, 2% water

| Solvent/Oil Ratio | % Raffinate | % Extract | % N Recovered in Extract | COS |
|---|---|---|---|---|
| 0.5 | TWO PHASES NOT FORMED | | | |
| 0.6 | 67 | 33 | 68 | 38 |
| 1.0 | 67 | 33 | 87 | 59 |
| 2.0 | 47 | 53 | 94 | 45 |
| 3.0 | 41 | 59 | 98 | 42 |
| 4.0 | 19 | 81 | 99 | 20 |

The data shows that the minimum solvent to oil ratio is between 0.5 and 0.6, below which two phases are not formed. As the solvent-to-oil ratio is increased above this minimum the percent of the total oil extracted increases and the percent of total nitrogen recovered increases. The optimum COS is exhibited at a ratio of about 1, below this ratio the recovery of nitrogen is not as effective and above this ratio the undesirable recovery of non-nitrogen compounds into the extract increases.

In the prior-art processes that aim to maximize the recovery of nitrogen, the highest recovery of nitrogen into the extract would be considered the most desirable, which in the above example would be at a solvent/oil ratio of 4. However, to achieve such a high recovery of nitrogen compounds in the extract there is also a much higher recovery of non-nitrogen compounds into the extract, which devalues the extract. Thus, by minimizing the nitrogen content of the raffinate to achieve the highest value raffinate, the value of the extract has been seriously compromised. In addition, the solvent requirements are much higher, increasing solvent recovery costs.

In the present invention, an object is to increase the separability of the nitrogen and non-nitrogen compounds, as measured by the COS. In this way, the combined value of the raffinate and extract fractions is optimized, rather than optimizing one fraction while seriously devaluing the other. In addition, this increase in value is achieved by a significant saving in solvent, as compared to typical prior-art practice.

Effect of Temperature

Raw Green River Formation kerogen oil possessing 1.8% nitrogen and an average molecular weight of 325 Daltons was subjected to a single-stage extraction in a separatory funnel. Solvent was added in a ratio of 1 part solvent to 1 part oil, shaken, brought to 42° C. by a heating bath, reshaken and phases allowed to separate. The extract and raffinate were recovered as described above and samples were subjected to elemental analysis. The coefficient-of-separation was calculated as described. The process was repeated under identical procedures except that the temperature was brought to 79.2° C. The results of the two tests were:

TABLE V

Effect of Temperature on Extraction Results
Feed-Total Green River Formation Kerogen Oil
N-content 1.6 wt. %
Average M.W. = 325 Dalton

| Solvent | T ° C. | E | % N | R | % N | COS |
|---|---|---|---|---|---|---|
| 90% Formic Acid 10% Water | 79.2° C. | 30.8 | 4.22 | 69.2 | 0.7 | 71.8 |
| 90% Formic Acid 10% Water | 42.0° C. | 30.8 | 4.36 | 69.2 | 0.69 | 74.8 |

The results show that the COS decreases with increasing temperature. This result may not be general for all hydrocarbonaceous oils and all selected solvent systems and there may be cases where higher temperatures result in a higher COS. The results show that temperature has an effect on COS and therefore must be considered when optimizing solvent systems and process variables.

Recovery of Solvent

Figure 4:
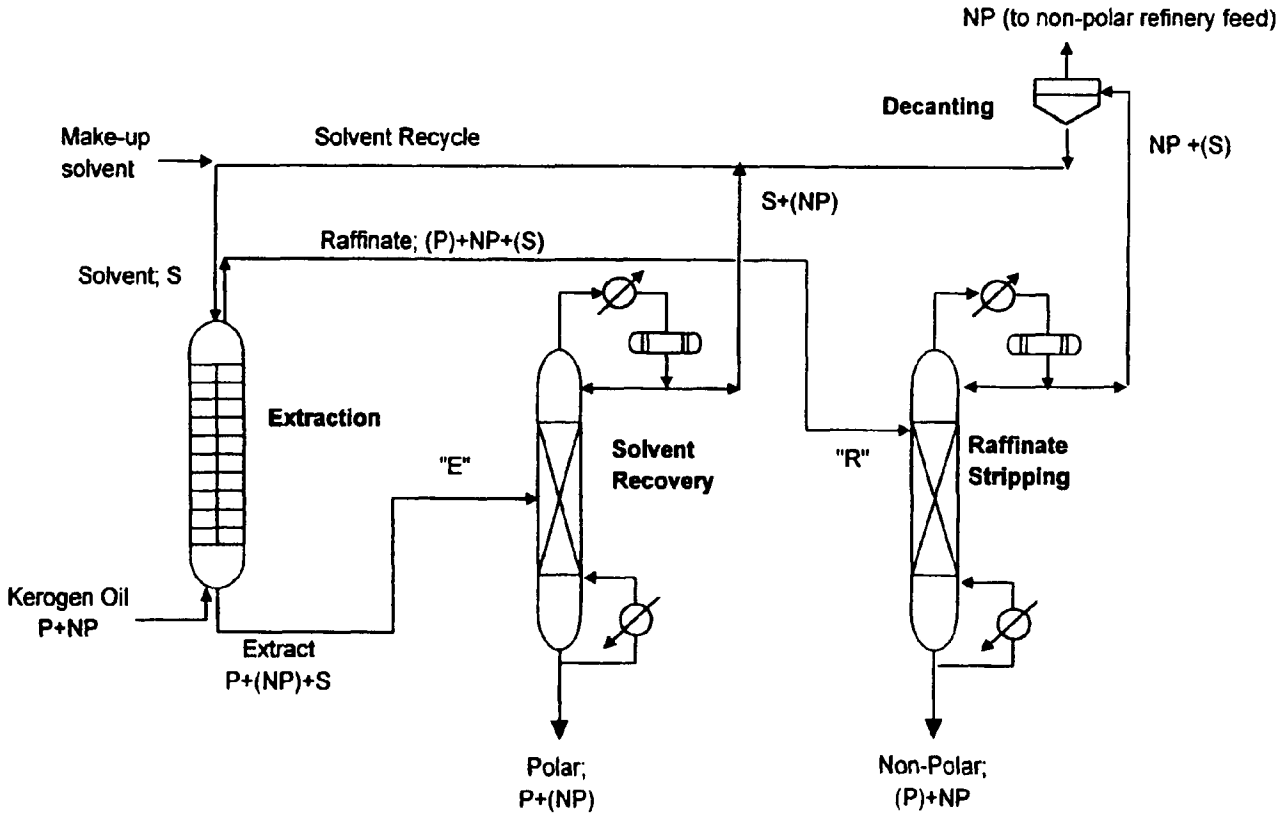
FIG. 4 is a block diagram of a solvent recovery process of the invention.

In general, the lower the boiling point the easier the solvent recovery process will be, albeit the lowest boiling of acceptable solvents may not necessarily provide the desired COS. Recovery of higher boiling solvents may be enhanced if they form convenient azeotropes with components of the oil. Such systems, if they simultaneously provide a high COS, are preferred. For example, FIG. 4 shows a diagram of a preferred solvent recovery scheme for the selected solvent of formic acid and water. In the recovery scheme extract and raffinate are sent to separate distillation apparatus where they are heated to distill the solvent. Formic acid forms an azeotrope with cyclic hydrocarbons and the boiling point of this azeotrope is lower than the boiling point of either formic acid or water. Likewise, water forms an azeotrope with certain light aromatics typically found in hydrocarbonaceous oils. The consequence is that solvent recovery is aided by the azeotropic distillation of components naturally occurring in the oil. Upon condensation these azeotropic distillates disengage into separate liquid phases, a low density, upper hydrocarbon phase and a high-density solvent phase. The light hydrocarbon phase can be recycled to the distillation apparatus to further assist the stripping of the solvent, reintroduced to the feed system to assist extraction selectivity, or withdrawn as product.

Typical Practice of Invention

In a typical practice of the invention hydrocarbonaceous oil is charged to one end of a countercurrent continuous extraction unit. Polar solvent is simultaneously introduced to the opposite end of the extraction unit. The choice of which end to introduce each stream will depend upon consideration of relative densities. The oil and the polar solvent are pumped to the system in proportions designed to maximize the COS while minimizing the solvent-to-oil ratio while the raffinate and the extract are withdrawn from the system in proportions to match their relative yields. Temperature is controlled at a predetermined level.

The extract and the raffinate are taken to separate units wherein the solvents are recovered from each stream and the solvent is recycled to the extraction unit. Fresh (makeup) solvent may be added to supplement process losses occurring through small amounts of solvent remaining in the extract or raffinate, or solvent may be removed (e.g., by a drag stream) to maintain quality of solvent. The extract and raffinate are subsequently used directly or are further processed to enhance their value.

In a preferred embodiment of the invention a kerogen oil derived from Green River Formation oil shale and containing high concentrations of nitrogen-containing compounds is pumped to the bottom of a column while a mixture comprised predominantly of a carboxylic acid with lesser amounts of water is pumped to the top of the column. In a preferred embodiment the choice of solvent is formic acid and water with formic acid being the major component, generally greater than 70% and water being the minor component, generally less than 30%. The oil may be presaturated with extraction solvent prior to pumping to the bottom of the column in order to accelerate the phase separation upon contact with the extraction solvent.

The temperature and solvent-to-oil flow ratio is selected so as to maximize the COS while minimizing the solvent-to-oil flow ratio. In general the selected solvent-to-oil ratio is less than 2 but greater than 0.5 with a typical ratio of about 1. The temperature of the column is controlled by any convenient means, generally between 20° C. and 120° C., but typically between 40° C. and 90° C.

The selected solvent system and the oil presaturated with the selected solvent system are continuously pumped in a countercurrent fashion where the two phases are allowed to contact each other by droplets of the discontinuous phase dispersed in the continuous phase. At the interface of these separate phases the non-heteroatom-containing compounds tend to partition to the raffinate phase while the heteroatom-containing compounds tend to partition to the extract phase. The extent to which this partitioning occurs, which is measured by the COS, depends upon the effectiveness of the contact system, the ratio of solvent-to-oil, the thermodynamic driving force resulting from the selection of the solvent system and the temperature of contact.

In the preferred practice of the invention the raffinate so produced will contain a minimum amount of solvent, generally less than 10% and typically 2-5%, and the extract will contain the remainder of the solvent feed. In the preferred practice of the invention the COS will be higher than 50% and will typically and most desirably exceed 65%.

Countercurrent Extraction of Raw Kerogen Oil with Formic Acid/Water and COS

Raw kerogen oil possessing 1.6% N and an average molecular weight of 325 Dalton was fed to the bottom of a countercurrent liquid-liquid contacting column refilled with selected solvent system while fresh extraction solvent comprised of 90% formic acid and 10% water was fed to the top of the column. The ratio of feed to fresh solvent was 1:1. On a volume basis, an extract comprised substantially of heteroatom-containing compounds and a majority of solvent was withdrawn from the bottom of the column. A raffinate comprised substantially of non-heteroatom-containing hydrocarbons and a minority of solvent was withdrawn from the top of the column. After removal of the solvent the measured polar oils (extract) comprised 30% of the feed material and exhibited 4.3% nitrogen. The recovered non-polar oils (raffinate) comprised approximately 70% of the feed material and exhibited 0.45% N. The recovery of nitrogen compounds is 80.4%. The coefficient-of-separation is 80.3% indicating essentially no non-nitrogen compounds in the extract.

Recovery of Solvent

In the preferred practice of the invention the raffinate and the extract are separately charged to a distillation apparatus as shown in FIG. 4 where they are heated to vaporize the formic acid/water solvent for recovery and recycle to the extraction system. In a typical practice the solvent recovery by distillation will be aided by the presence of cycloparaffins and aromatics which form azeotropes with the selected formic acid/water system. In such cases the condensate of this vapor will form two phases, a lower phase comprised principally of formic acid and water which is drawn off for recycle to the extraction system and an upper phase comprised principally of low boiling naphthenic and aromatic hydrocarbons which are drawn off and returned to the respective concentrate from which they came. In a typical practice of the invention a portion of the naphthenic and aromatic light hydrocarbon material separated from the distillation condensate may be recycled to the concentrate prior to distillation to enhance the recovery of selected solvent through stripping and enhanced azeotropic effect. Light hydrocarbon material recovered from the raffinate stripping column may be added to the bottoms of the solvent recovery column to aid with stripping of solvent from the extract (details not shown in FIG. 4). In an alternative practice of the invention a fraction of this naphthenic/aromatic light hydrocarbon material may be recycled to the kerogen oil prior to presaturation with selected solvent to modify the solvent properties of the oil phase for purposes of enhancing the COS while minimizing the solvent-to-oil ratio. The mass balance for a typical process of solvent recovery, modeled from thermodynamic properties is given in Table VI.

TABLE VI

Composition of Solvent Recovery Unit Process Streams

| Product Stream | Composition | | |
|---|---|---|---|
| | Polar | Non-Polar | Solvent |
| Extract: feed to the Solvent Recovery (SR) unit | 33.28 | 0.16 | 66.56 |
| Raffinate, feed to the Raffinate S tripping (RS) unit | 0.48 | 94.52 | 5.0 |
| Distillate of SR unit to solvent recycle | 0.005 | 0.024 | 99.97 |
| Bottom of SR unit, polar products | 99.58 | 0.42 | 0 |
| Distillate of RS unit to decanting unit | 0 | 63.66 | 36.34 |
| Bottom of RS unit, non-polar products | 0.43 | 99.51 | 0.05 |
| Solvent Recycle | 0.004 | 0.07 | 99.92 |

The raffinate which has been stripped of selected solvent may be used directly as a petroleum refinery feed or it may be further processed to enhance its value. The extract from which the solvent has been removed may be used directly or it may be further processed to enhance its value.

Applications, Uses and Processing of Extract

Applications

The production of an extract that is high in heteroatom-containing molecules and low in non-heteroatom-containing compounds and resulting from an extraction of a hydrocarbonaceous oil exhibiting a coefficient of separation greater than 50% may be used in the following applications:

- Directly as an additive to asphalt binders to enhance the antistrip properties.
- Directly as a surfactant for industrial use.
- Directly as a solvent or dispersant for industrial use.
- Directly as an additive for viscosity reduction.
- As a feedstock for manufacture of surfactants such as pyridine N-oxides and pyridinium@ salts.
- As a feedstock for manufacture of solvents such as mixed lower alkylpyridines (LAPs) or mixed phenols and mixed dihydroxybenzenes.
- As a feedstock for manufacture of antistrip asphalt additive such as distillation or mild polymerization of total extract.
- As a feedstock for manufacture of additives for fuels and lubricants such as sludge dispersants.
- As a feedstock for manufacture of agrochemicals such as paraquat, diquat, or chlorpyrfos.
- As a feedstock for manufacture of nutritional and pharmaceutical products such as niacin or pyridomycin.
- As a feedstock for manufacture of polymers and resins such as substitutes for coal tar indene or coumerone resins for manufacture of phenols or epoxy resins.
- As a feedstock for manufacture of antimicrobials such as cetyl pyridinium chloride, piperidine or phenolics.
- As a feedstock for manufacture of fungicides such as those derived from phenols and pyridines.
- As a feedstock for manufacture of dyes such as those based on quinoline acridines, naphthols or dihydroxybenzenes.
- As a feedstock for manufacture of flavors and fragrances such as those containing the indole structure.

A person of skill in the art will appreciate that the above mentioned are examples and doe not include all of the possible applications.

Direct Use of Extract

Preferably, direct use of extract will be made in markets for which there is a high-volume. High-volume applications minimize important limitations on the capacity of the plant. Examples of high volume uses to which the raw extract may be made are additives for improving the properties of asphalt, surfactants for improving interfacial properties of mixed phases, solvents for dissolution or dispersion of solids and precipitates, fuels, and materials constructed through the polymerization or derivitation of the extract. The terms "direct use" and "high-volume" are generally interchangeable.

Asphalt Additives

A high nitrogen antistrip additive produced by extraction of polar heteroatom-containing compounds from raw kerogen oil was tested for its antistripping characteristics by a Water Susceptibility Test (WST). The antistrip additive was mixed with an asphalt binder. Rheological measurements were made on the stripping-prone, neat asphalt and the asphalt-additive mixture to ensure that the additive did not adversely affect the asphalt viscosity. Viscosity measurements at 25° C. and 60° C. showed the viscosity reduction to be within acceptable limits.

Briquettes consisting of five mass percent asphalt and asphalt with 4% extract with 20-35 mesh aggregate particles were made following the Plancher et al. procedure as described in "Canadian Technical Asphalt Association Proceedings", vol. XXV, p. 246-262, November 1980, except that the briquettes were compacted at 4000 psi instead of 6200 psi. The briquettes were tested by subsequent freeze thaw cycles until failure. Duplicate test designated as R1 and R2 were performed. The results are given in Table VII.

The cycles to failure increased in every case with the addition of the extract additive (sample number KPX-98-107). The results indicate that adding extract imparts measurable improvement to the moisture damage resistance of the above-described asphalt-aggregate mixtures. Examination of the data in Table 5 also shows that moisture damage resistance is also sharply dependent upon aggregate composition but in each case for a given aggregate the extract antistripping additive showed beneficial effects.

Other process steps may be taken to affect the rheologic and performance properties of such an antistrip additive. For example, mild oxidation or mild polymerization of naturally occurring olefin bonds would increase the viscosity and may add beneficial properties to the additive.

TABLE III

Moisture Sensitivity Test Results, Cycles to Failure*

| | Aggregates (20-35 mesh size) | | | | | |
|---|---|---|---|---|---|---|
| | RJ | | RA | | RG | |
| Sample | R1 | R2 | R1 | R2 | R1 | R2 |
| AAF-1 | 1 | 1 | 2 | 2 | 8 | 8 |
| AAF-1 4% KPX-98-107 | 1 | 2 | 3 | 3 | >16* | >16* |

*Cycles to failure greater than 12 are considered to be essentially equivalent and very moisture insensitive.

Ionic Surfactants

Alkyl-substituted pyridines extracted from kerogen oil can be converted to cationic surfactants by reaction with alkyl chlorides. The resulting quaternary pyridinium surfactants ("quats") will be quite different from commercial materials due to the long-chain alkyls attached to the pyridinic ring. This will result in unique behavior and properties.

Most commercially available cationic surfactants are quaternary aliphatic ammonium compounds, but the marketplace includes quite a variety of variations on these themes. An example of the pyridine derivatives is cetylpyridinium chloride, used in a number of personal care products.

Quaternary ammonium surfactants are used in a broad variety of consumer and industrial formulations (Table VII). A major traditional application is in disinfectants, taking advantage of the bactericidal properties of many of these compounds.

The largest businesses are in consumer products, because of the importance of fabric softeners, virtually all of which are quats made from aliphatic amines. The other rapidly growing application is in hair conditioners, the largest application in personal care products.

TABLE VII

Cationic Surfactants
(Share of 1.16 million MT/yr. world market)

| End-Product | Market Share |
|---|---|
| Fabric softeners | 23% |
| Personal care (especially shampoo conditioners) | 19% |
| Textile auxiliaries | 12.6% |
| Dishwash detergents | 10.5% |
| Household cleaners | 7.8% |
| Biocides | 4% |
| Industrial and institutional laundry and cleaning | 3.6% |
| Laundry detergents | 2% |
| Other (asphalt emulsifiers, corrosion inhibitors, fuel additives, plastics additives, and all others) | 17.5% |

Data from Chemical Market Reporter, 26 Jan 1998.

Commercial pyridine-derived quats have the nitrogen buried in the middle, with a long alkyl chain on the nitrogen. Surfactant properties are controlled by altering the lengths of the chain to give varied solubility, interfacial activity, etc.

The quats made from kerogen oil would be similar, except that the long chain would be on the ring. The opportunity comes from using a methyl or ethyl group on the nitrogen and relying on the long alkyl chain attached to the ring as the fatty end. The cationic site thus has the acid/base properties one would expect from a nitrogen in a pyridine yet the oleophilic/hydrophilic properties are those of a long-chain alkyl making a "fatty pyridine".

In some applications, kerogen-derived pyridines could be used as surfactants without N-alkylation. In these, small amounts of mineral acid could be added to form the pyridinium cation. In some systems, naturally occurring acidic species would convert the pyridine to a pyridinium. The cost for production of such quats is also low because methyl or ethyl substitution is inexpensive on a molar basis.

The uniqueness of kerogen-derived pyridines is both an advantage and a disadvantage. The advantage comes from the lack of competitive materials. Making a "fatty pyridine" from conventional synthetic pyridine requires something akin to Friedel-Crafts alkylation of benzene, except that the reaction will probably require an extra step to protect the N from substitution by the alkyl chloride. The disadvantage comes from the absence of identified market for these materials. For these reasons it was not possible to test for market acceptability of these potential products.

Solvents and Dispersants

The heteroatom content of extracts makes these concentrates excellent solvents for organic sludges, resins, precipitates and the like. Both pyridine concentrates from Green River Formation kerogen oil and phenolic concentrates from Kukersite kerogen oil or coal pyrolysis liquids will have beneficial properties in certain applications. For example, pyridinic kerogen oil extract may be used to remove sludge from tank bottoms, pipelines and other industrial equipment. These extracts may be useful for metal winning oils in metallurgical applications or for anticorrosion additives. Phenolic concentrates may be used for solution of sludges or for pour point depressants in petroleum application.

Processing of Extract

Distillation

A preferred step in the processing of extract is to distill the extract into a distillate fraction and a bottoms or residue fraction. The distillate fraction and bottoms fractions are subsequently separately processed. For example, the distillate fraction may be used directly as a light industrial solvent or it may be sent to hydrodealkylation processing to remove alkyl groups leaving the parent ring systems substantially free of alkyl and methyl groups. The residue fraction may be used directly for uses similar to the total extract or it may be subjected to cracking to reduce its average molecular weight.

In an alternative process the extract may be distilled into a light and heavy distillate and a bottoms. The light distillate may be used directly or sent to thermal hydrodealkylation processing, the heavy distillate may be sent to a cracking process to reduce its molecular weight and the bottoms may be used directly or processed to manufacture asphalt additives, ionic surfactants, dispersants or the like.

Cracking of Extract

The extract contains heterocyclic compounds that have methyl groups and longer alkyl chains attached to the ring(s). These methyl and alkyl groups must be cracked from the ring(s) to reduce the molecule to its parent ring(s) system. In general, such cracking may occur either catalytically or thermally. Catalytic cracking over solid Si—Al catalysts may be used for feedstocks of low nitrogen content such as for Kukersite kerogen oil extract. Calculations based on theoretical chemistry and computational analysis suggest that a Kukersite shale oil extract comprising in excess of 35 weight percent of the total kerogen oil and containing in excess of 80% hydroxyaromatics may be catalytically cracked to yield a crackate product comprised predominantly of mono- an dihydroxyaromatics. These hydroxyaromatics may contain methyl and ethyl substituents that may be removed by THDA as described further below. Catalytic cracking may be performed by any convenient commercial process used today in the petroleum industry. Conversely, a high nitrogen extract, which tends to react unfavorably with solid Si—Al catalyst, may be thermally cracked either by coking or by hydropyrolysis. Coking may be performed by any convenient commercial process used today in the petroleum industry.

Hydropyrolysis

Figure 5:
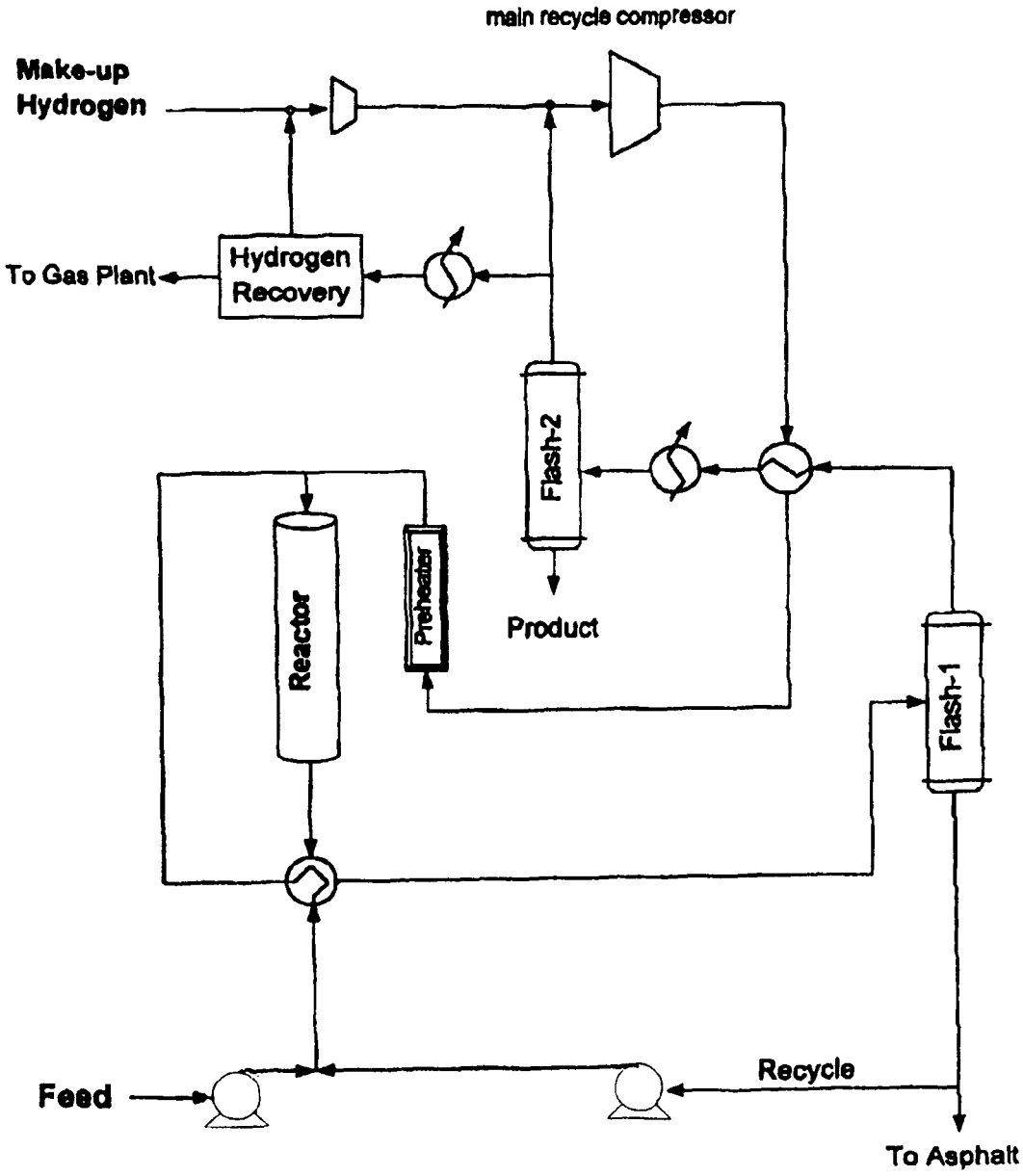
FIG. 5 is a block diagram of a hydropyrolysis process of the invention

Hydropyrolysis is a short contact time, thermal hydrocracking process. (See Flow Diagram in FIG. 5.) The objective of hydropyrolysis is to crack alkyl chains without producing coke from pyridines, phenols or aromatics. In hydropyrolysis it is desirable to inhibit dehydrogenation of naphthenes. The high hydrogen pressure and short contact times accomplish this. If the feedstock contains material that cannot be vaporized at the reaction temperature and pressure the reactor system must accommodate a mixed phase. It is undesirable to 'over-crack' because to do so generates non-condensable gases which are of less value than liquids and which result in high hydrogen consumption.

For example, hydropyrolysis of a >290° C. extract from a Green River Formation kerogen oil at 540° C., 1500 psi H2 pressure, and 6-30 sec residence time, yielded 82 to 85% liquids, 7 to 12% gases and 5 to 9% coke. In a larger reactor the amount of coke can be reduced to nearly zero because coke is formed only when droplets impinge on the reactor walls. A small amount of water is also observed, which results from hydropyrolysis of oxygen-containing compounds. Methane is the predominant gaseous component.

Simulated distillation of the liquid products shows that the amount of distillable material increases from 32% to 71%. The hydrogen-to-carbon molar ratio of the liquid products remains about the same as that of the feed (1.37); nevertheless, the amount of nitrogen increases from 3.79% to 4.49%. This enrichment comes from the fact that the gases derive from non-nitrogen-containing alkyl groups that are attached to the heteroatom-containing rings. The HP liquid products may be recycled to the extraction step to separate the heteroatom-containing ring compounds from non-heteroatom-containing hydrocarbons that are predominantly the alkyl chains previously attached to the rings. The hydrocarbon portion of the hydropyrolyzate is predominantly diesel range material. The addition of this material to the refinery feed significantly enhances its value for petroleum refining. Thus, there are benefits that accrue from hydropyrolysis by increasing the amount of middle distillate in the refinery feed that are in addition to the benefits of dealkylation dealkylation of heteroatom-containing ring systems.

The analysis of the hydropyrolysis liquid products shows small amounts of pyridine and picolines and large amounts of tri- and tetra-methylated pyridines. Because most of the pyridines in the kerogen oil are tri- and tetra-substituted and hydropyrolysis is not designed to demethylate, the low concentrations of picoline and pyridine are expected. The observed results are consistent with the compositional analysis and expected chemistry. The demethylation of methyl substituted pyridines may be accomplished through additional crackate processing as described further below.

Crackate Processing

The crackate obtained from cracking of extract contains numerous components comprised of the ring systems with methyl groups and short alkyl chains attached and hydrocarbon products that were the long alkyl groups attached to the rings in the original extract. This process stream must be further processed before it is of appreciable use. A preferred approach is to recycle the cracked products or crackate to the extraction step where the heteroatom-containing ring systems are extracted along with heteroatom-containing compounds originally in the hydrocarbonaceous oil.

With the recycle of the crackate, the efficiency of the extraction step also improves. The lower viscosity and the 'solvating' effect of lighter polar compounds helps extract the heavier polar compounds that have long alkyl chains attached and have an appreciable affinity for the raffinate fraction.

For example, the liquid product (crackate) obtained from hydropyrolysis (HP) of the >290° C. extract from a Green River Formation kerogen oil was extracted with formic acid/water according the practice of the invention to separate a polar extract from a non-polar raffinate. After the extraction, the solvent was carefully removed by distillation. The distribution of the resulting extract and raffinate was 76% and 24%, respectively. Compositional analysis of the two fractions showed barely detectable levels of non-polar hydrocarbons in the extract. A COS of 74% was calculated.

The nitrogen content of the polar extract was measured at 6.0%. GC/MSD analysis of the polar extract of the HP products showed that the majority of the identifiable compounds are pyridine derivatives. Alkyl pyrroles, quinolines, isoquinolines, indoles, and carbazoles are also identified.

Upon extraction of heteroatom-containing components the polar extract may be topped by distillation. The choice of topping temperature is made to control the composition of the light distillate. For example, if naphthalene, quinoline or other higher ring aromatics are not desired products then the topping might be conducted at 200° C. or less. If these dicyclic types are desired, the topping temperature may be raised to include these types. Such reasoning may also be applied to distillation of high oxygen content hydrocarbonaceous oils where it may be desirable to separate dihydroxybenzenes (such as resorcinols, from monohydroxybenzenes such as phenols). In practice, fractionation of the extract may be made flexible enough to change product objectives as market conditions dictate.

Similarly the temperature of the heavy distillate cutpoint can be selected so as to enhance the operation of the cracking unit. For example, when the cutpoint is selected at about 350° C. the distillate that is lighter than 350° C. material may be sent to the cracking unit in the vapor phase reducing operating difficulties. In such a case the coke formation will be minimal. Alternatively, the cutpoint for the distillation may be increased to about 530° C. atmospheric equivalent boiling point (the actual distillation is conducted under high vacuum to avoid cracking in the distillation step) and the lighter than 530° C. material is sent to the cracking unit. This alternative is contemplated when catalytic cracking is employed or when higher yields of low molecular weight heteroatom-containing compounds are desired.

THDA Processing

Figure 2:
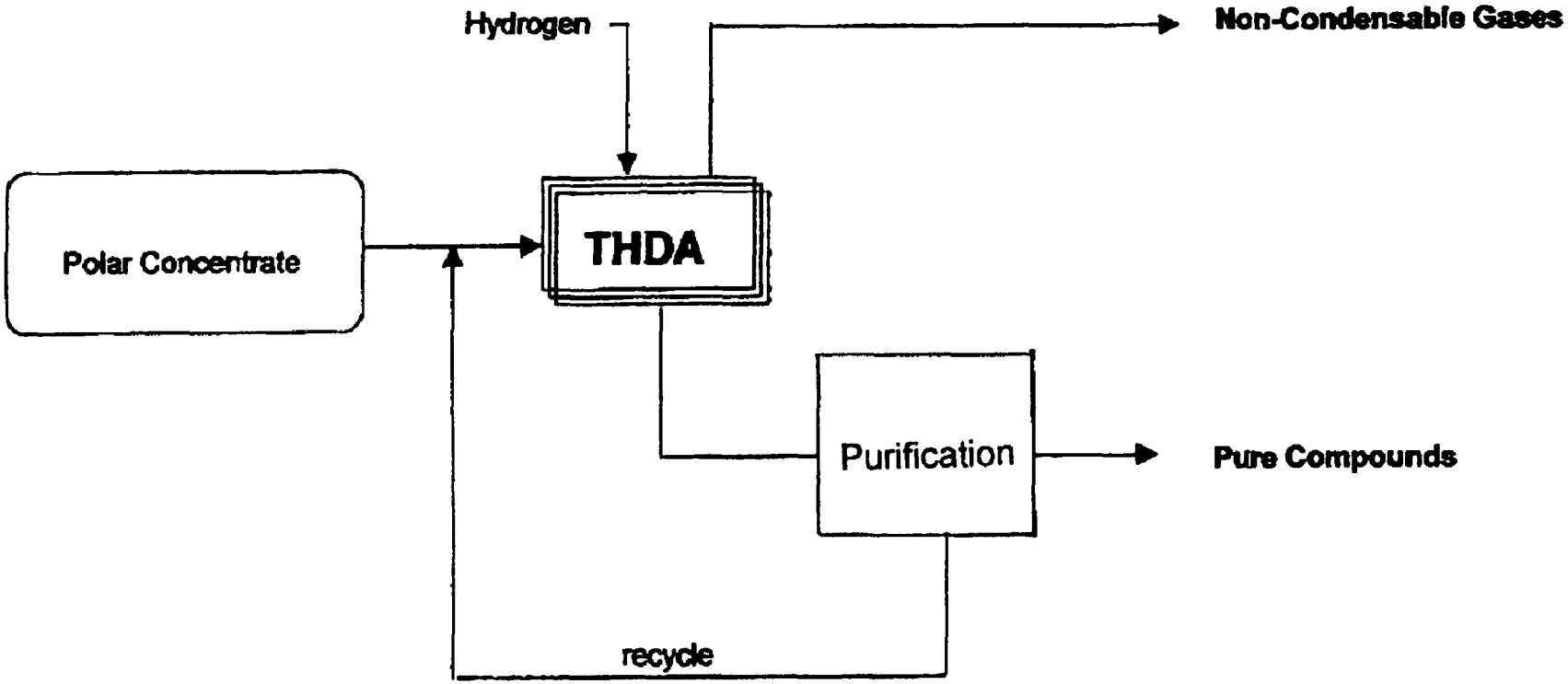
FIG. 2 is a block diagram of a dealkylation process of the invention.

A key feature of the preferred scheme is the use of HP, coking or catalytic cracking to crack alkylated types to their methylated homologs thereby concentrating these types in a narrow and predictable boiling range. After subsequent extraction of the crackate the extract may be distilled as described. In a preferred embodiment the <200° C. extract may now be subjected to vapor-phase thermal hydrodealkylation THDA, to demethylate the rings. Process conditions for this step are similar to those used when hydrodealkylating toluene to benzene, namely, T>600° C., $P_{H2}$<1000 psi, t<60 seconds. Steam may also be added to reduce coke formation and enhance the process operability. The flow diagram for this step is shown in FIG. 2. If the feedstock is derived from Green River Formation kerogen oil then the primary products from THDA are pyridines, pyrroles and single ring aromatics. Products that possess boiling points higher than the desired end products may be recycled for further dealkylation. If extract is from a Kukersite kerogen oil the distillation may be performed at a temperature of about 300° C. and the THDA be operated to produce phenol, cresols, resorcinol and methyl resorcinols.

Purification Processing

Figure 3:
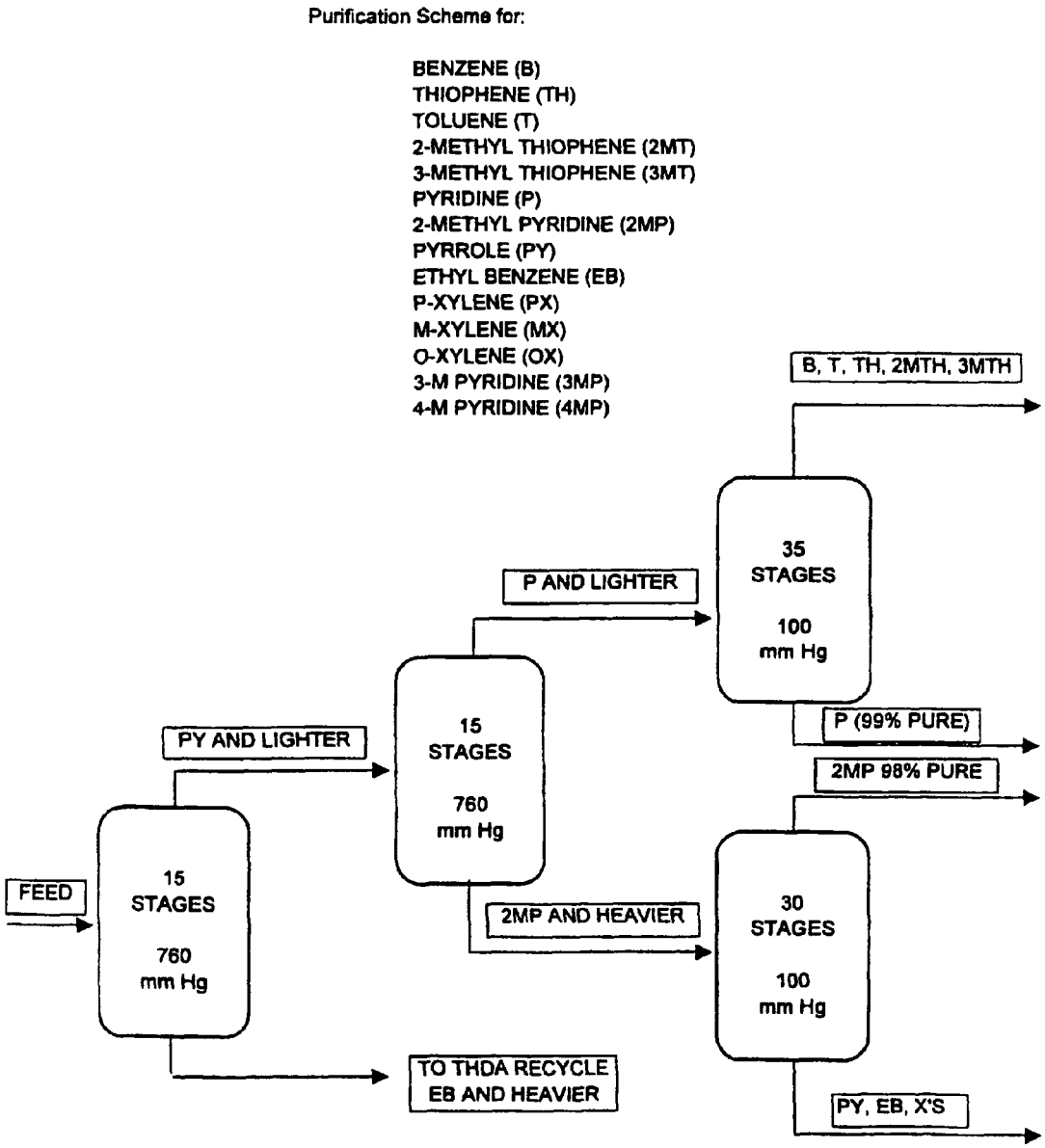
FIG. 3 is a block diagram of a purification process of the invention.

A separation scheme for product refinement is given in FIG. 3. The scheme is designed to maximize the purity of pyridine and -picoline (2-methylpyridine). The major separation problem in purifying pyridine is the presence of toluene and methylthiophenes that possess similar boiling points. The major separation problem in purifying alpha-picoline is the presence of pyrrole and, to a lesser extent, C8 aromatics. Streams other than pyridine and alpha-picoline are comprised of aromatic byproducts that also have an appreciable market value.

A similar process sequence is contemplated for high oxygen kerogen oils such as those produced from Kukersite oil shale or Eastern Queensland Tertiary oil shale (Australia). The extract may first be divided into light, middle and heavy fractions with the middle fraction hydropyrolyzed or catalytically cracked for primary dealkylation and the dealkylated material is then re-extracted to produce a concentrate of oxygen rich components, primarily phenolics. This concentrate may then be directly separated for pure compounds or further processed in THDA to further dealkylate methyl groups prior to purification.

Processing, Applications and Uses of Raffinate

Applications

The product of a raffinate that is low in heteroatom-containing molecules and high in non-heteroatom-containing compounds and resulting from an extraction of hydrocarbonaceous oil exhibiting a coefficient-of-separation greater than 50% may be used for the following applications:

Directly as a feedstock to a petroleum refinery.

As a feedstock for the manufacture of a sweet synthetic crude oil.

As a feedstock for manufacture of distillate fuels.

As a feedstock for manufacture of lube oils and waxes.

As a feedstock for manufacture of chemicals such as olefins and aromatics.

Direct Use

A primary use contemplated for the raffinate is as a substitute petroleum feedstock. Removal of heteroatoms renders the raffinate more easily processed to petroleum products. The raffinate may be sent directly to a petroleum refinery without further upgrading and processed to manufacture a traditional product slate of motor gasoline, diesel fuel, jet fuel, waxes, lube oils and the like.

Manufacture of Sweet Synthetic Crude Oil

Alternatively, the raffinate may be catalytically hydroprocessed to further remove nitrogen, sulfur or oxygen heteroatoms and to hydrogenate unstable olefins. If this step is performed the resulting product is a premium-value, sweet synthetic crude oil.

For example, about one liter of Green River Formation kerogen oil raffinate (N=0.35%, S=0.97%, 31.0°API) was subjected to a mild hydrotreating step to obtain a stabilized refinery feed. The process employed a commercial hydrotreating (sulfided Ni—Mo) catalyst at 290° C. and 800 psig hydrogen partial pressure. The oil was fed at 1.55 LHSV. Hydrogen flow rate was held at a hydrogen-to-oil ratio of 680 SCF/bbl.

After hydrotreating, the API gravity of the sweet synthetic crude oil improved to 36.8□API. The sulfur and nitrogen contents were reduced to 200 ppm and 1200 ppm, respectively. Specifications of the sweet synthetic crude oil are given in Table IX.

TABLE IX

Specification of Sweet Synthetic Crude Oil

| CRUDE PROPERTIES | |
|---|---|
| Gravity, degrees API | 36.8 |
| Specific Gravity (60 □F/60 □F) | 0.841 |
| Total Sulfur, ppm | 200 |
| Total Nitrogen (mostly non-basic), ppm | 1200 |
| UOP K Factor | 12.0 |
| Pour Point, □F | 39 |
| Viscosity at 100 □F, cSt | 3.3 |
| Vanadium, ppm wt | <1 |
| Nickel, ppm wt | <1 |
| Conradson Carbon, wt. Pct. | nil |
| Asphaltenes, wt. Pct. | <0.25 |
| Ash Content, wt. Pct. | nil |

DISTILLATION PROFILE (obtained from Simulated Distillation)

| Distillation Fraction | Yield, wt % | Cumm. wt % |
|---|---|---|
| Naphtha (<200 □C) | 29.8 | 29.8 |
| Kerosene (200 275) | 16.2 | 46.0 |
| Gas Oil (275 325) | 12.3 | 58.3 |
| Heavy Gas Oil (325 400) | 23.2 | 81.5 |
| Vacuum Gas Oil (400 538) | 19.5 | 100.0 |

The compound type distribution of the feedstock and the products is given in Table X and shows a reduction in olefins and aromatics due to hydrogenation and an increase in isoparaffins due to ring opening.

TABLE X

Comparison of Compound Types in a Raffinate and a Stabilized Refinery Feedstock

| Compound | Weight Percent | | |
|---|---|---|---|
| Types | Feed | Product | Description |
| Paraffins | 31.3 | 34.8 | From $C_8$ to $C_{34}$ |
| Isoparaffins | 10.7 | 35.7 | From $C_9$ to $C_{22}$ |
| Aromatics | 19.8 | 14.7 | Alkylbenzenes and Alkylnaphthalenes |
| Naphthenes | 15.4 | 12.1 | Cycloalkanes and Alkylcycloalkanes |
| Olefins | 22.8 | 2.7 | Alkenes and Alkylcycloalkenes |

Distillation Processing

Alternatively, the raffinate may be distilled to separate the raffinate into distillate and a residue. The cutpoint for such a distillation may be similar to the cutpoint made in a petroleum refinery in the atmospheric (crude) tower. For example, the distillate may be sent to a catalytic hydrotreater as described above while the residue boiling in the gas oil range may be sent to a catalytic cracker. The residue from the distillation step is an acceptable feedstock to a catalytic cracking unit because it is low in basic nitrogen as a result of the extraction of polar nitrogen compounds as a practice of the invention. In catalytic cracking the gas oil range material is cracked over an acid (Si—Al) catalyst where high-octane gasoline components are produced directly.

Alternatively, the catalytically hydroprocessed sweet refinery feed may be distilled and the distillate sent to process for manufacture of motor gasoline, diesel fuel, kerosene, jet fuel and the like, while the residue from the distillation may be sent to a catalytic cracker for manufacture of high octane gasoline components.

Other uses of the raffinate may be made as a consequence of the low heteroatom content achieved through the practice of the invention. For example, light naphtha may be fed to steam cracking for manufacture of olefins and aromatics. Benzene, toluene and xylenes (BTX) may be extracted from the naphtha. Other such uses for which there is an advantage by having low concentrations of heteroatoms are contemplated by the invention.

Overall Process of the Invention

The overall preferred process of the invention is shown in FIG. 1. A hydrocarbonaceous oil is extracted by a selected solvent system chosen so as to maximize the coefficient-of-separation of the desired heteroatom-containing compounds while minimizing the solvent-to-oil ratio and yielding acceptable recovery of solvent and the extraction yielding a coefficient-of-separation of at least 50% and typically greater than 65% of desired heteroatom-containing compounds in the extract fraction. The extract is distilled into three fractions, the bottoms being used directly for commercial use, the heavy distillate being sent to a cracking unit where substantially all of the alkyl side chains are removed from the heteroatom-containing rings leaving the methylated homologs, the crackate being recycled to the extraction unit where heteroatom-containing compounds are recovered in the extract and non-heteroatom-containing compounds, that were the alkyl side groups in the original extract, are recovered in the raffinate.

The light distillate that contains low molecular weight heteroatom-containing compounds originally in the hydrocarbonaceous oil along with additional low molecular weight heteroatom-containing compounds that were produced in the cracking process are sent to a thermal hydrodealkylation unit where substantially all of the methyl groups are removed from the heteroatom-containing rings and the products of THDA purified for their pure compound values by distillation, extraction, crystallization, adsorption, derivitization, or other appropriate means.

The raffinate of the extraction which contains the non-heteroatom-containing compounds in the original hydrocarbonaceous oil plus any non-heteroatom-containing compounds produced in the cracking unit and subsequently separated in the extraction step is sent to a catalytic hydroprocessing unit to produce a sweet synthetic crude oil.

Figure 6:
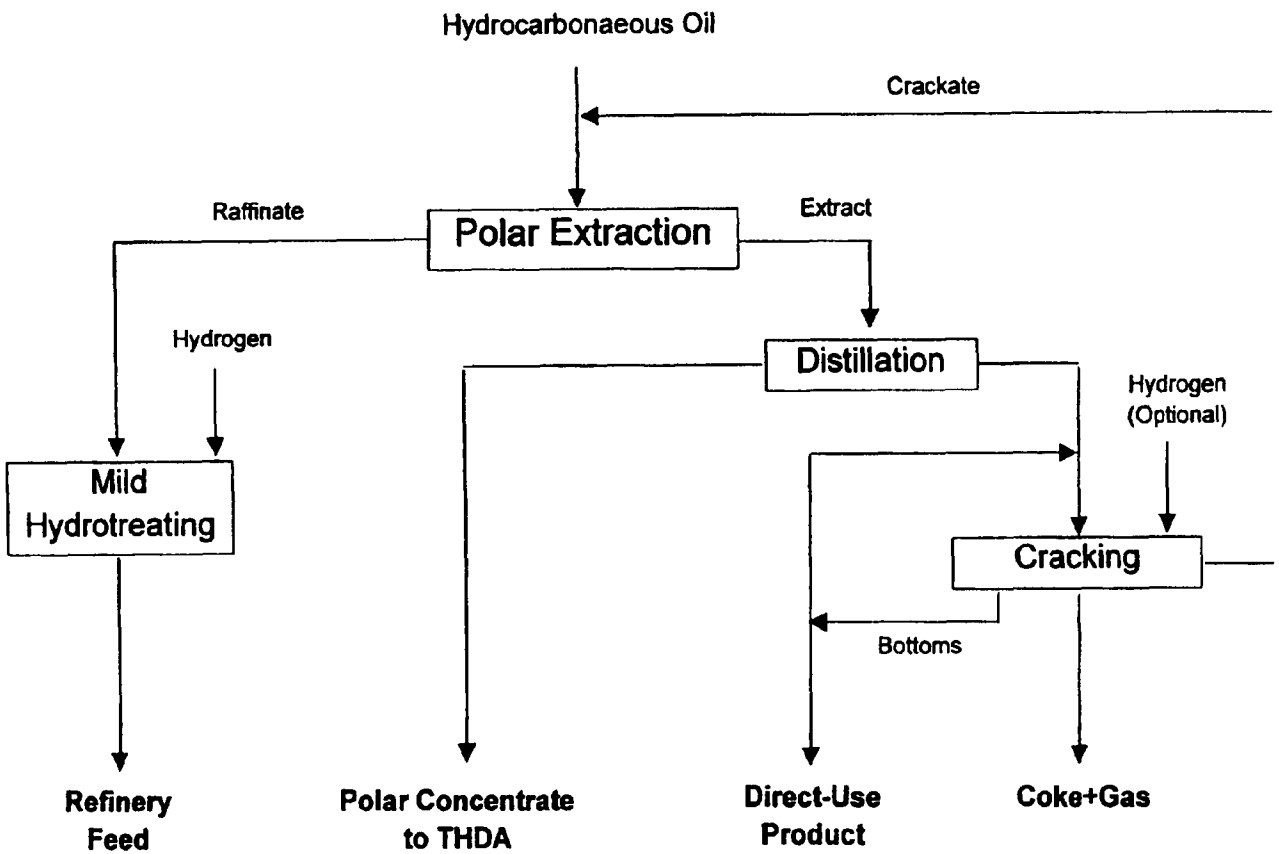
FIG. 6 is a block diagram of an alternate process of the invention.

An overall alternative preferred process of the invention is shown in FIG. 6. A hydrocarbonaceous oil is extracted by a selected solvent system chosen so as to maximize the coefficient-of-separation of the desired heteroatom-containing compounds while minimizing the solvent-to-oil ratio and yielding acceptable recovery of solvent and the extraction yielding a coefficient-of-separation of at least 50% and typically greater than 65% of desired heteroatom-containing compounds in the extract fraction. The extract is distilled into two fractions, the bottoms being sent to a cracking unit where substantially all of the alkyl side chains are removed from the desired heteroatom-containing rings, the crackate being recycled to the extraction unit where heteroatom-containing compounds are recovered in the extract and non-heteroatom-containing compounds, that were the alkyl side groups in the original extract, are recovered in the raffinate. A drag stream of non-volatiles from the cracking unit may be withdrawn, if desired, to prevent buildup of the heaviest materials.

The light distillate that contains low molecular weight heteroatom-containing compounds originally in the hydrocarbonaceous oil along with additional low molecular weight heteroatom-containing compounds that were produced in the cracking process are sent to a thermal hydrodealkylation unit where substantially all of the methyl groups are removed from the heteroatom-containing rings and the products of THDA purified for their pure compound values by distillation, extraction, crystallization, adsorption, derivitization, or other appropriate means.

The raffinate of the extraction which contains the non-heteroatom-containing compounds in the original hydrocarbonaceous oil plus any non-heteroatom-containing compounds produced in the cracking unit and subsequently separated in the extraction step is sent to a catalytic hydroprocessing unit to produce a sweet synthetic crude oil.

Figure 7:
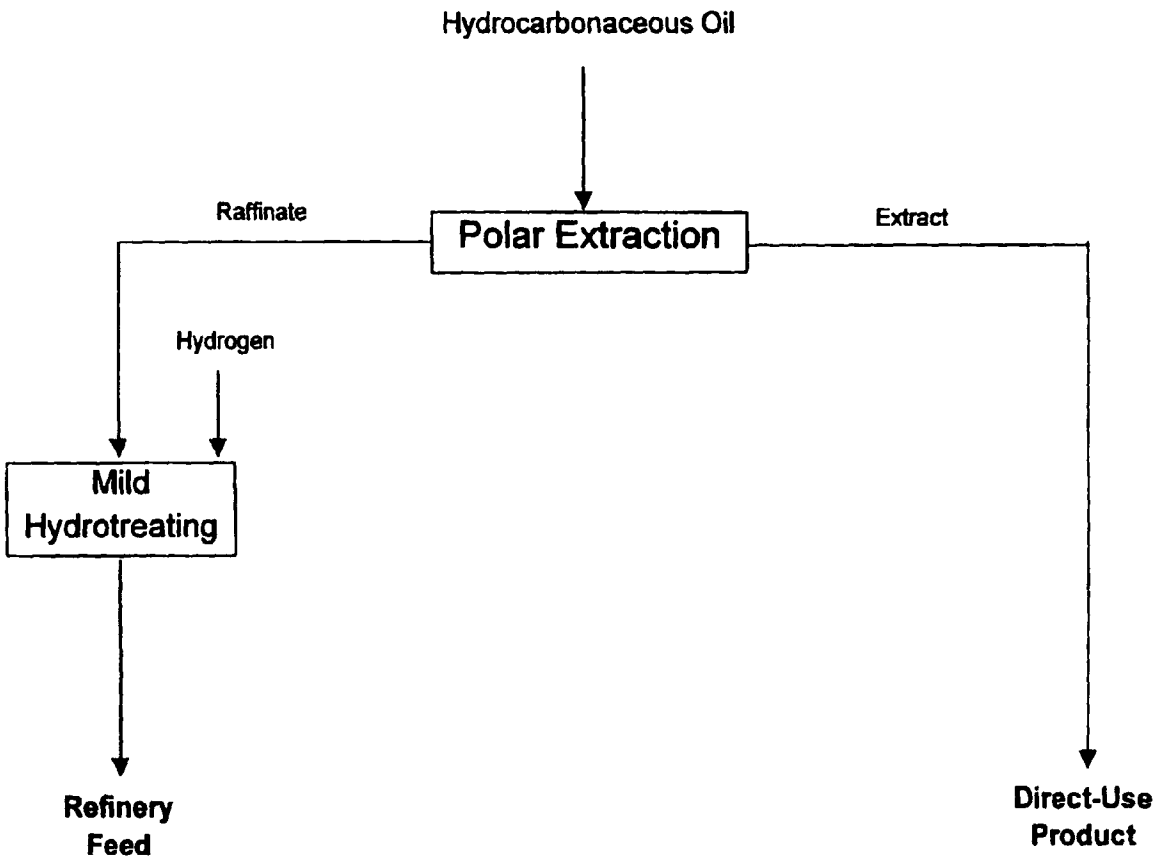
FIG. 7 is a block diagram of a second alternate process of the invention.

A second alternative preferred process of the invention is shown in FIG. 7. A hydrocarbonaceous oil is extracted by a selected solvent system chosen so as to maximize the coefficient-of-separation of the desired heteroatom-containing compounds while minimizing the solvent-to-oil ratio and yielding acceptable recovery of solvent and the extraction yielding a coefficient-of-separation of at least 50% and typically greater than 65% of desired heteroatom-containing compounds in the extract fraction. The extract is used directly for commercial use, or directly or as a feedstock for manufacture of commercial products. The raffinate of the extraction, which contains the non-heteroatom-containing compounds in the original hydrocarbonaceous oil, is sent to a catalytic hydroprocessing unit to produce a sweet synthetic crude oil.

One skilled in the art may appreciate that other variations are possible without departing from the spirit of the invention which is in essence to upgrade the value of a hydrocarbonaceous oil by first selectively separating it into its heteroatom-containing compounds and its non-heteroatom-containing compounds and processing said non-heteroatom-containing compounds for their use as a petroleum substitute and direct use of or processing the heteroatom-containing compounds for one or more processed uses. Direct use products are those that receive little or no further processing after the non-heteroatom-containing compound stream and the heteroatom-containing compound stream are created by a process of the invention. Processed products of enhanced market value are those produced by further chemical processing of the heteroatom-containing process stream or further distillation or hydroprocessing of the non-heteroatom-containing process stream.

What is claimed is:

1. A process for extracting heteroatom-containing compounds from hydrocarbonaceous oil containing non-heteroatom-containing compounds and containing recoverable amounts of heteroatom-containing compounds, the process comprising:

contacting the hydrocarbonaceous oil with a solvent system comprising a mixture of a major portion of a polar solvent having a dipole moment greater than about 1 debye and a minor portion of water to selectively separate the constituents of the hydrocarbonaceous oil into a raffinate fraction and an extract fraction, the polar solvent selected to form an azeotrope with at least one low-molecular weight component of the extract or raffinate, the polar solvent and the water-in-solvent system formulated at a solvent ratio where the water is an antisolvent in an amount to inhibit solubility of heteroatom-containing compounds and the polar solvent in the raffinate, and to inhibit solubility of non-heteroatom-containing compounds in the extract, maximizing the coefficient of separation to a value of at least 50% by adjusting the solvent ratio, ratio of contacting the hyrocarbonaceous oil to the solvent system, and process conditions of contacting of the hydrocarbonaceous oil with the solvent system where the coefficient of separation is the mole percent of heteroatom-containing compounds from the hydrocarbonaceous oil that are-recovered in the extract fraction minus the mole percent of non-heteroatom-containing compounds from the hydrocarbonaceous oil that are recovered in the extract fraction.

2. The process of claim 1 wherein the hydrocarbonaceous oil is one of or a mixture of biomass, gilsonite, coal, oil sands, oil shale, petroleum, and derivatives of biomass, gilsonite, coal, oil sands, oil shale, petroleum.

3. A process for the processing of heteroatom-containing hydrocarbonaceous oil comprising:

extracting the hydrocarbonaceous oil to produce a raffinate fraction depleted of heteroatoms, and an extract fraction enriched with heteroatoms and including molecules containing heteroatom ring systems that contain non-heteroatom moieties and heteroatoms within or directly bonded to a ring system;

processing the extract fraction to produce a residue portion of the extract fraction;

processing the residue portion to remove non-heteroatom-containing moieties from heteroatom ring systems to produce heteroatom-containing molecules with heteroatom rings systems absent the on-heteroatom-containing moieties, and non-heteroatom-containing compounds comprising the removed moieties originally attached to the heteroatom ring systems;

recovering the heteroatom-containing molecules with heteroatom ring systems-from which non-heteroatom moieties have been removed and, recovering the non-heteroatom-containing compounds comprising removed moieties.

4. The process of claim 3 wherein the non-heteroatom-containing moieties include cycloalkyl rings.

5. The process of claim 4 wherein the non-heteroatom-containing moieties include aliphatic chains.

6. A process for upgrading of heteroatom-containing compounds comprising:

extracting the hydrocarbonaceous oil by a selected solvent to form a concentrate of heteroatom-containing compounds;

removing selected solvent from the concentrate of heteroatom-containing compounds under azeotropic distillation conditions where the solvent and at least one low-molecular weight component of the concentrate forms an azeotrope to form a solvent portion and a hydrocarbon portion of heteroatom-containing compounds;

distilling the hydrocarbon portion of heteroatom-containing compounds to produce one or more distillate fractions and one or more residue fractions, processing the distillate fractions and residue fraction for manufacture of specialty or commodity chemical products, said manufacture comprising one or more of the processes of distillation, dealkylation, oxidation, hydrogenation, crystallization or derivitization.

7. The process of claim 6 wherein the processing the distillate comprises producing one distillate fraction and one residue fraction and the distillate fraction is processed by thermal hydrodealkylation and the residue fraction is processed by cracking, hydropyloysis, or chemical means of dealkylation.

8. The process of claim 6 wherein the removed polar solvent containing azeotropically distilled components is recycled to the extracting step.

9. The process of claim 1 additionally comprising separating the polar solvent from the raffinate by an azeotropic distillation to form a two phase condensate with a heavier phase principally comprising water and solvent, and a lighter phase principally comprising hydrocarbon.

10. The process of claim 1 additionally comprising separating the polar solvent from the extract by adding one or more non-polar, cyclic hydrocarbons that form an azeotrope with the solvent in an amount to increase recovery of the solvent in azeotropic distillation and conducting an azeotropic distillation to form a two-portion condensate with a heavier portion principally comprising water and solvent, and a lighter portion principally comprising hydrocarbon.

11. The process of claim 3 additionally comprising;

recycling the processed residue portion to the hydrocarbonaceous oil, and wherein heteroatom-containing molecules with heteroatom ring systems from which non-heteroatom moieties have been removed are recovered in the extract fraction and wherein non-heteroatom-containing compounds comprising removed moieties originally attached to heteroatom ring systems are recovered in the raffinate fraction.

12. The process of claim 11 wherein the extract fraction is distilled to form a lower weight molecular fraction containing heteroatom-containing molecules with heteroatom ring systems-from which non-heteroatom moieties have been removed, and the lower weight molecular fraction is treated to remove methyl groups and short alkyl chains attached to ring systems.

13. The process of claim 12 wherein the distilling also forms a middle molecular weight fraction which comprises the portion of the extract fraction in the processing.

14. The process of claim 12 wherein treating the lower molecular weight fraction comprises thermal hydrodealkylation.

15. The process of claim 3 wherein the processing a portion of the extract fraction to remove the non-heteroatom comprises thermal cracking, catalytic cracking, oxidation, or derivitization.

16. The process of claim 15 wherein the processing a portion of the extract fraction to remove the non-heteroatom comprises hydropyrolysis.

* * * * *